US006100000A

United States Patent [19]

Anno et al.

[11] Patent Number: 6,100,000

[45] Date of Patent: Aug. 8, 2000

[54] DEVELOPER COMPRISING TONER AND/OR CARRIER HAVING SPECIFIED AVERAGE DEGREE OF ROUNDNESS AND SPECIFIED STANDARD DEVIATION OF DEGREE OF ROUNDNESS

[75] Inventors: Masahiro Anno, Sakai; Katsunori Kurose, Amagasaki; Chikara Tsutsui, Nishinomiya; Minoru Nakamura, Takarazuka; Hiroyuki Fukuda, Sanda, all of Japan

[73] Assignee: Minolta Co., Ltd., Osaka, Japan

[21] Appl. No.: 09/291,054

[22] Filed: Apr. 14, 1999

[30] Foreign Application Priority Data

Apr. 15, 1998 [JP] Japan ..... 10-104452
Mar. 18, 1999 [JP] Japan ..... 11-073794

[51] Int. Cl.[7] ..... G03G 9/083; G03G 9/107

[52] U.S. Cl. ..... 430/106.6; 430/108; 430/111

[58] Field of Search ..... 430/109, 111, 430/122, 126, 106.6, 108

[56] References Cited

U.S. PATENT DOCUMENTS

| | | | |
|---|---|---|---|
| 4,996,126 | 2/1991 | Anno et al. | 430/106.6 |
| 5,066,558 | 11/1991 | Hikake et al. | 430/109 |
| 5,206,109 | 4/1993 | Anno | 430/137 |
| 5,350,657 | 9/1994 | Anno et al. | 430/111 |
| 5,800,959 | 9/1998 | Ikami | 430/111 |
| 5,809,378 | 9/1998 | Kukimoto et al. | 430/111 |
| 5,858,593 | 1/1999 | Tamura et al. | 430/111 |

FOREIGN PATENT DOCUMENTS

| | | |
|---|---|---|
| 63-319037 | 12/1988 | Japan . |
| 01257857 | 10/1989 | Japan . |
| 04226476 | 8/1992 | Japan . |
| 06317928 | 11/1994 | Japan . |
| 06317933 | 11/1994 | Japan . |
| 9-258474 | 10/1997 | Japan . |

*Primary Examiner*—John Goodrow
*Attorney, Agent, or Firm*—McDermott, Will & Emery

[57] ABSTRACT

The present invention relates to developer comprising a toner and/or a carrier;

the toner comprising:

toner particles comprising colored resin-particles containing at least a binder resin and a colorant, and inorganic fine particles fixed on the surface of the colored resin-particles, the toner particles having an average degree of roundness of not less than 0.960 and a standard deviation of degree of roundness of not more than 0.040;

and carrier having an average degree of roundness of not less than 0.940 and a standard deviation of degree of roundness of not more than 0.055.

38 Claims, 6 Drawing Sheets

DEVELOPER COMPRISING TONER AND/OR CARRIER HAVING SPECIFIED AVERAGE DEGREE OF ROUNDNESS AND SPECIFIED STANDARD DEVIATION OF DEGREE OF ROUNDNESS

This application is based on application(s) No. Hei 10-10445 and Hei 11-73794 filed in Japan, the contents of which are hereby incorporated by reference.

BACKGROUND OF THE INVENTION

1. Field of the Invention

The present invention relates to a developer for developing an electrostatic latent image for use in electrophotography, electrostatic printing, and the like. The invention also relates to a developer (toner and carrier) for use in a direct recording-apparatus in which toner is forced to fly from a toner supporting-member directly onto a recording member so that toner images are formed.

2. Description of the Related Art

Developers for developing electrostatic latent images for use in electrophotography, electrostatic printing, and the like have been produced by a kneading-pulverizing method or by wet processes such as a suspension polymerization method. Further, it has been known to surface-modify developer particles by various means (mechanical impact force, heat, or the like) after preparation of the developer in order to improve the properties of particles produced by the above method. Among those methods, a process of instantaneous heat treatment for surface modification has been known. For example, Japanese Patent Application Laid-Open Nos. Hei 6-317928 to Hei 6-317933 disclose about an instantaneous heat-treatment of a magnetic toner. In these prior art publications, there is a statement that if the temperature for treatment is set high, particle agglomeration may occur, and that in order to cope with such a problem it is desirable to use a binder resin having a melting viscosity of $1\times10^4$–$5\times10^5$ (poise) at 135° C. and $3\times10^3$–$3\times10^5$ (poise) at 145° C. However, with such resin properties shown in these publications, it is impracticable to use such a resin in a low temperature fixing/high speed system. This system is increasingly required in recent years. Further, such a resin cannot satisfy resin properties required of the resin for use in a full color system and lacks general purpose.

Japanese Patent Application Laid-Open No. Hei 4-226476 discloses a toner (non-magnetic toner) in which after resin particles and a developer composition (including carbon black, quaternary ammonium salt having a mean particle size of several $\mu$m, and polypropylene etc.) are mixed together, the mixture is instantaneously heat-treated for melting and adherence. In such a method, however, agglomeration and coalescence (bonding) of particles are unavoidable.

In a conventional method it may have been possible to modify the surface conditions to enhance the performance quality of the developer. Recently, however, in copying apparatuses and printers, an image quality of higher level has been required more than ever. In order to meet such a requirement it is necessary to achieve improvement on the machine side with respect to copying apparatuses, developing devices etc. In addition, it is essential to achieve functional improvement of developers. In order to improve the function of the developer, it is necessary to control variations in particle configuration of individual developer particles and to enhance characteristic uniformity of the surface of individual particles. In this sense, the prior art method has not reached the characteristic level required for above mentioned purposes. Further property-improvement has been demanded.

SUMMARY OF THE INVENTION

It is an object of the present invention to provide a developer having a uniformly and spherically controlled particle shape and uniform properties of particle surface excellent in no pores and smoothness, and a method of production of the developer.

DETAILED DESCRIPTION OF THE INVENTION

Figure 1:
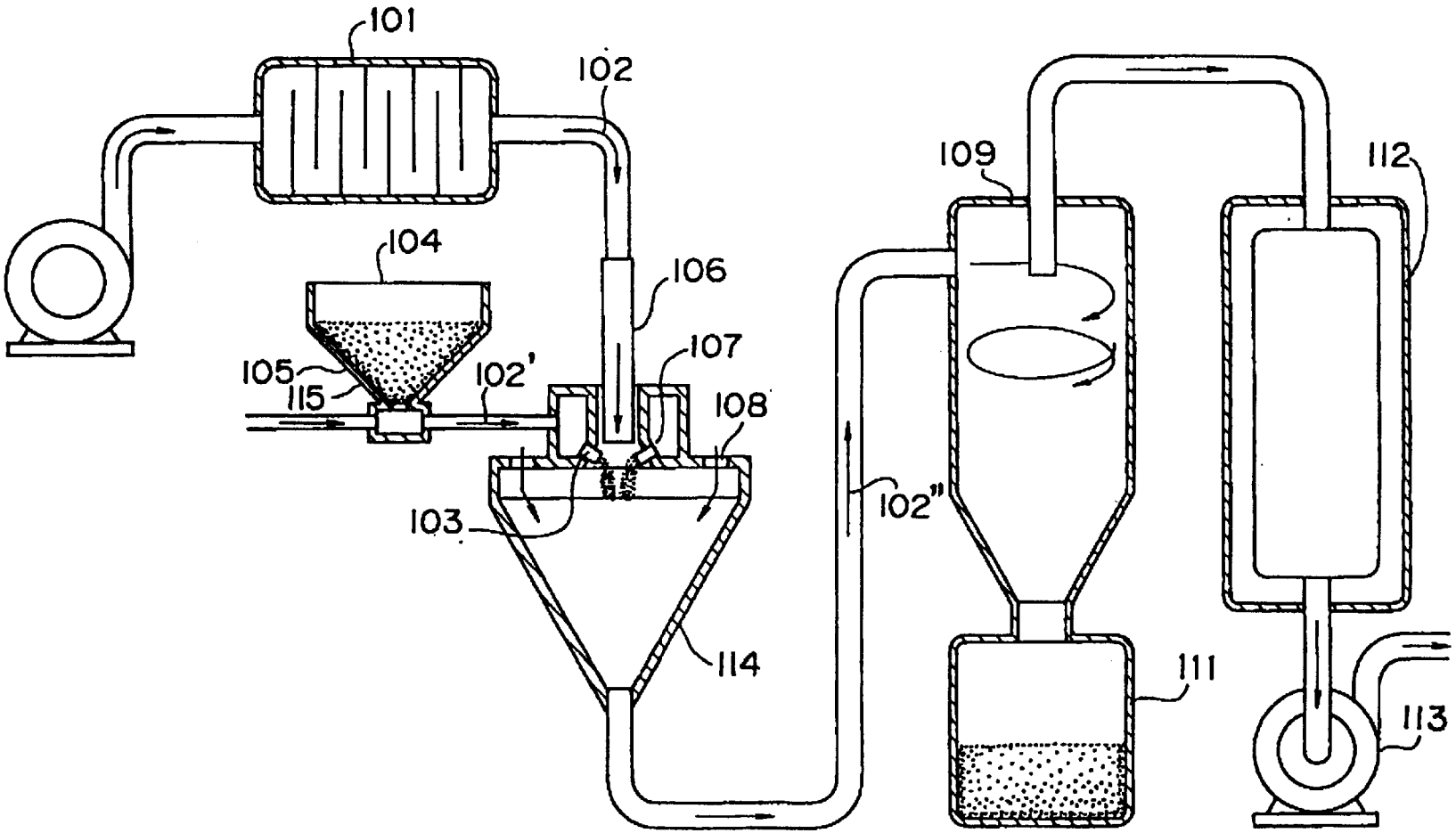
FIG. 1 is a schematic view showing structure of device for carrying out instantaneous heating treatment.

The present invention relates to a non-magnetic toner, comprising:

toner particles comprising colored resin-particles containing at least a binder resin and a colorant, and inorganic fine particles fixed on the surface of the colored resin-particles, the toner particles having an average degree of roundness of not less than 0.960 and a standard deviation of degree of roundness of not more than 0.040.

According to the present invention, uniform properties of particle surface are improved and variations of individual particles are reduced. Therefore, electrification-build-up properties of toner are improved and the distribution of electrical charge is made sharp. As a result, a noise trouble, such as fogging, is reduced and image-quality improvement can be achieved. Further, undesired phenomenon such as selective development (a phenomenon such that a toner having a particular particle size and electrical charge is preferentially consumed) is prevented and a stable quality of toner is ensured even if a copying process is repeated many times.

With respect to a carrier, the same improvements as those in the case of toner can be achieved since the carrier can be improved in its function to uniformly charge the toner.

Furthermore, the use of the toner of the present invention can enhance efficiency in developability and transferabilty, resulting in wideness in the window for machine-setting conditions. In the carrier, it is possible to enhance uniformity of chargeability and improvement of developability and further to uniformly increase an electric resistance of carrier surface. Therefore, it is possible to restrain carrier development (voids) (noises caused by development carrier itself). The present invention can remarkably improve functions required in developers.

First, an explanation will be given of a toner. The toner of the present invention comprises at least a binder resin and a colorant.

With respect to the binder resin, thermoplastic resins, used for toner binder resins, are used. In the present invention, those resins having a glass transition point of 50 to 75° C., a softening point of 80 to 160° C., a number-average molecular weight of 1,000 to 30,000 and a ratio of weight-average molecular weight/number-average molecular weight of 2 to 100, are preferably used.

In particular, in the case of preparation for full-color toner (including black toner), it is preferable to use resins having a glass transition point of 50 to 75° C., a softening point of 80 to 120° C., a number-average molecular weight of 2,000 to 30,000 and a ratio of weight-average molecular weight/number-average molecular weight of 2 to 20.

In the case of preparation for oil-less fixing toner or magnetic toner, a binder resin containing a first resin having a softening point of 80 to 125° C. and a glass transition point of 50 to 75° C. and a second resin having a softening point of 125 to 160° C. and a glass transition point of 50 to 75° C. is preferably used.

With respect to the toner binder resin component, a polyester resin, which has an acid value of 2 to 50 KOHmg/g, 3 to 30 KOHmg/g is used preferably. By using the polyester resin having such an acid value, it is possible to improve the dispersing properties of various pigments including carbon black and charge-control agents, and also to provide a toner having a sufficient quantity of charge. The acid value less than 2 KOHmg/g reduces the above-mentioned effects. The acid value exceeding 50 KOHmg/g fails to stably maintain the quantity of toner charge against environmental fluctuations, in particular, fluctuations in humidity.

With respect to the polyester resin, polyester resins, obtained by polycondensating a polyhydric alcohol component and a polycarboxylic acid component, may be used.

Among polyhydric alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, isododecenyl succinic acid, n-dodecyl succinic acid, n-dodecyl succinic acid, isododecyl succinic acid, n-octenylsuccinic acid, isooctenyl succinic acid, n-octyl succinic acid, isooctyl succinic acid, and anhydrides of these acids or low alkyl esters.

Examples of tri- or more carboxylic acid components include alkyl ester methacrylates, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides of these acids, and low alkyl esters.

In the present invention, with respect to the polyester resin, a material monomer for a polyester resin, a material monomer for a vinyl resin and a monomer that reacts with both of the material monomers are used, and a polycondensating reaction for obtaining a polyester resin and a radical polymerization reaction for obtaining a styrene resin are carried out in parallel in the same container. Resins thus obtained may be preferably used. The monomer that reacts with both of the resin material monomers is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the material monomers for polyester resins include the above-mentioned polyhydric alcohol components and polycarboxylic acid components.

Examples of the material monomers for vinyl resins include: styrene or styrene derivatives, such as styrene, o-methylstyrene, m-methylstyrene, p-methylstyrene, α-methylstyrene, p-ethylstyrene, 2,4-dimethylstyrene, p-tertbutylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinyl acetate, vinyl benzoate, vinylmethyl ethyl ketone, vinyl hexyl ketone, vinyl methyl ether, vinyl ethyl ether, and vinyl isobutyl ether. Examples of polymerization initiators used upon polymerizing the material monomers for vinyl resins include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methylethylketone peroxide, isopropylperoxycarbonate and lauroyl peroxide.

Moreover, for a binder resin component, vinyl resins constituted of the above-mentioned material monomers may be used. Among vinyl resins, styrene-acrylic resins, which are obtained by copolymerizing styrene or styrene derivatives and alkyl methacrylates and/or alkyl acrylates, are preferably used.

In the present invention, in order to improve the fixing properties for oil-less fixing toners as well as improving the anti-offset properties, or in order to control the gloss properties for images in full-color toners requiring a light-transmitting properties, it is preferable to use two kinds of binder resins having different softening points as its binder resins. For oil-less fixing toners, the first binder resin having a softening point of 80 to 125° C. is used so as to improve the fixing properties, and the second polyester resin having a softening point of 125 to 160° C. is used so as to improve the anti-offset properties. In this case, if the softening point of the first resin is lower than 80° C., the anti-offset properties are reduced and the reproducibility of dots is reduced, and the softening point exceeding 125° C. fails to provide sufficient effects for improving the fixing properties. If the softening point of the second resin is lower than 125° C., the effects for improving the anti-offset properties become insufficient, and the softening point exceeding 160° C. reduces the fixing properties. For this reason, the softening point of the first resin is more preferably set from 95 to 120° C., preferably 100 to 115° C., and the softening point of the second resin is more preferably set from 130 to 160° C., preferably 135 to 155° C. Glass transition points of the first and second polyester resins are preferably set from 50 to 75° C., preferably from 55 to 70° C. This is because, when the glass transition point is too low, the heat resistance of toner becomes insufficient and when it is too high, the pulverizing performance during manufacturing processes is reduced, resulting in a low production efficiency. The softening point of the second resin is preferably set higher than the softening point of the first resin by not less than 10° C., preferably not less than 15° C.

A ratio of weight of the first resin and the second resin is set at 7:3 to 2:8, preferably 6:4 to 3:7. The application of the first resin and the second resin in such a range provides a superior dot-reproducibility with less toner's expansion due to crushing at the time of fixing and a superior low-temperature fixing properties. This makes it possible to ensure a good fixing properties both in high-speed and low-speed image-forming apparatuses. Moreover, it is possible to ensure a superior dot-reproducibility even in double-sided image-forming processes (in which two passages are made through the fixing device). The ratio of the first resin less than the above-mentioned range makes the low-temperature fixing properties insufficient, and fails to ensure a wide range of fixing properties. The ratio of the second resin less than the above-mentioned range tends to reduce the anti-offset properties and cause toner's expansion due to crushing at the time of fixing, resulting in degradation in the dot-reproducibility.

In the full-color process requiring light-transmitting properties, resins of a sharply-melting type, which have a sharp molecular weight distribution, are conventionally used. The use of such type of resins makes it possible to reproduce glossy and pictorial images. However, in recent years, in color copying normally used in offices, there are increasing demands for images with less degree of gloss. In order to meet such demands, for example, the molecular weight distribution of the resin is widened to the high-molecule side. One of the specific methods for this is to use two or more kinds having different molecular weights in a combined manner. When the resin thus obtained finally through the combination has a glass transition point of 50 to 75° C., a softening point of 80 to 120° C., a number-average molecular weight of 2,500 to 30,000 and a ratio of weight-average molecular weight/number-average molecular weight in the range of 2 to 20, it is preferably adopted. When copied images are desired to have less gloss, the value of the ratio of weight-average molecular weight/number-average molecular weight is set at not less than 4 so that the melt-viscosity curve is tilted. Thus, it becomes possible to expand the gloss-degree controlling-range with respect to the fixing temperature.

Epoxy resins may be preferably used, in particular, in full-color toners. Examples of epoxy resins preferably used in the present invention include polycondensated products of bisphenol A with epichlorohydrin. For example, Epomic R362, R364, R365, R367, R369 (made by Mitsui Sekiyukagaku K.K.), Epotot YD-011, YD-012, YD-014, YD-904, YD-017 (made by Touto Kasei K.K.) and Epi Coat 1002, 1004, 1007 (made by Shell Kagaku K.K.) are commercially available.

The softening point of resin is measured with a test specimen of 1 $cm^3$ by using a flow tester (CFT-500; made by Shimadzu Seisakusho K. K.) under the conditions of die orifice of 1 mm in diameter and 1 mm in length, a pressure of 20 $kg/cm^2$ and a temperature-rising rate of 6° C./min. A temperature corresponding to ½ of the height of from the start of effusion of the test specimen and up to the end of the effusion when the test specimen is melt and effused is taken as the softening point. The glass transition point is measured with a 10 mg test specimen by using a differential scanning calorimeter (DSC-200; made by Seiko Denshi K. K.) under the conditions of a temperature-rising rate of 10° C./min within a temperature range between 20° C. and 120° C., with alumina used as the reference. The shoulder value of a main endothermic peak is taken as the glass transition point. The acid value is a value calculated from a quantity of a N/10 potassium hydroxide/alcohol solution which is consumed when a 10 mg test specimen dissolved in 50 ml of toluene is titrated with the standardized N/10 potassium hydroxide/alcohol solution by using a mixed indicator of 0.1% bromothymol blue and phenol red. The molecular weights (number-average molecular weight and weight-average molecular weight) are values converted in terms of styrene by using gel permeation chromatography (GPC).

In order to improve the anti-offset properties, etc., the toner of the present invention may contain a wax. Examples of such a wax include polyethylene wax, polypropylene wax, carnauba wax, rice wax, sazol wax, montan ester waxes, Fischer-Tropsch wax, etc. In the case of addition of a wax to the toner, the content is preferably in the range of 0.5 to 5 parts by weight relative to 100 parts by weight of the binder resin. Thereby, it becomes possible to obtain the effects of the addition without causing disadvantages, such as filming, etc.

From the viewpoint of improvement in anti-offset properties, polypropylene wax is preferably contained. From the viewpoint of improvements in smear-preventive properties ("smear" means a phenomenon in which, when a paper-sheet with images copied on its one side is fed by an automatic document-feeding apparatus or in a double-sided copying machine, degradation in the copied image, such as blurring and stains, occurs due to friction between the sheets or between the sheet and rollers on the image), polyethylene wax is preferably contained. From the above-mentioned view points, the polypropylene wax is preferably set to have a melt viscosity of 50 to 300 cps at 160° C., a softening point of 130 to 160° C. and an acid value of 1 to 20 KOH mg/g. The polyethylene wax is more preferably set to have a melt viscosity of 1,000 to 8,000 cps at 160° C. and a softening point of 130 to 150° C. The polypropylene wax having the above-mentioned melt viscosity, softening point and acid value exhibits a superior dispersing properties to the binder resin. The anti-offset properties are improved without causing problems due to isolated wax. In particular, when polyester resin is used as the binder resin, oxidized-type waxes are preferably used.

Examples of waxes of oxidized type include oxidized polyolefin waxes, carnauba wax, montan wax, rice wax, and Fischer-Tropsch wax, etc.

With respect to polypropylene waxes which are polyolefin waxes, low molecular weight polypropylene has a small hardness to cause the defect of lowering the toner fluidity. It is preferable that those waxes are modified with carboxylic acid or acid anhydride in order to improve the above defects. In particular, modified polypropylene resins in which a low molecular polypropylene resin is modified with one or more kinds of acid monomers selected from the group consisting of (metha)acrylate, maleic acid and maleic acid anhydride, are preferably used. Such a modified polypropylene may be obtained, for example, by subjecting a polypropylene resin to a graft or addition reaction with one or more kinds of acid monomers selected from the group consisting of (metha) acrylate, maleic acid and maleic acid anhydride in the presence of a peroxide catalyst or without a catalyst. When the modified polypropylene is used, the acid value is set in the range of 0.5 to 30 KOHmg/g, preferably 1 to 20 KOHmg/g.

With respect to the oxidized-type polypropylene waxes, Viscol 200TS (softening point 140° C., acid value 3.5), Viscol 100TS (softening point 140° C., acid value 3.5), Viscol 110TS (softening point 140° C., acid value 3.5), each of which is made by Sanyo Kasei Kogyo K.K., etc., are commercially available.

With respect to oxidized-type polyethylene, commercially available products are: San Wax E300 (softening point 103.5° C., acid value 22) and San Wax E250P (softening point 103.5° C., acid value 19.5), made by Sanyo Kasei Kogyo K.K.; Hi-Wax 4053E (softening point 145° C., acid value 25), 405MP (softening point 128° C., acid value 1.0), 310MP (softening point 122° C., acid value 1.0), 320MP (softening point 114° C., acid value 1.0), 210MP(softening point 118° C., acid value 1.0), 220MP(softening point 113° C., acid value 1.0), 4051E(softening point 120° C., acid value 12), 4052E(softening point 115° C., acid value 20), 4202E (softening point 107° C., acid value 17) and 2203A (softening point 111° C., acid value 30), made by Mitsui Sekiyukagaku K.K., etc.

When carnauba wax is used, the ones of fine crystal particles are preferably used with their acid value preferably in the range of 0.5 to 10 KOHmg/g, preferably 1 to 6 KOHmg/g.

Montan waxes generally refer to montan ester waxes refined from minerals, being in the form of fine crystals as well as carnauba wax; the acid value thereof is preferably in the range of 1 to 20, and more preferably, 3 to 15.

Rice wax is obtained by air-oxidizing rice bran wax, and its acid value being preferably in the range of 5 to 30 KOHmg/g.

Fischer-Tropsch wax is a wax that is produced as a by-product when synthetic oil is produced from coal according to the hydrocarbon-synthesizing method. Such a wax, for example, is available as trade name "sazol wax" made by Sazol K.K. Fischer-Tropsch wax, made from natural gas as a starting material, may be preferably used since it contains less low molecular weight ingredients and exhibits a superior heat resistance when used with toner.

With respect to the acid value of Fischer-Tropsch wax, those having an acid value of 0.5 to 30 KOHmg/g may be used. Among sazol waxes, those of oxidized type having an acid value of 3 to 30 KOHmg/g (trade name: sazol wax A1, A2, etc.) are, in particular, preferably used. Polyethylene wax having the above-mentioned melt viscosity and softening point also exhibits a superior dispersing properties to the binder resin, thereby improving the smear-preventive properties because frictional coefficient of the surface of a fixed image is reduced without causing problems due to isolated wax. The melt viscosity of wax was measured by a viscometer of the Brook Field type.

Known pigments and dyes are used as colorants for full-color toner. Examples of them include carbon black, aniline blue, chalcoil blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. With respect to black toner, various kinds of carbon black, active carbon and titanium black may be used. The colorant may be replaced partially or all with a magnetic material. For such a magnetic material, for example, known magnetic fine particles such as ferrite, magnetite and iron, may be used. In order to achieve sufficient dispersing properties at the production time, an average particle size of the magnetic particles is preferably not more than 1 $\mu$m, preferably not more than 0.5 $\mu$m. When added from the viewpoint of prevention of toner scattering while maintaining the characteristics of a non-magnetic toner, its amount of addition is 0.5 to 10 parts by weight, preferably 0.5 to 8 parts by weight, more preferably 1 to 5 parts by weight, relative to 100 parts by weight of the binder resin. If the amount is more than 10 parts by weight, the magnetic force of the developer support member (incorporating a magnet roller inside) to the toner is excessively high, so that the developability is lowered.

In case that the toner is used as a magnetic toner, the magnetic material is preferably contained at an amount of 20 parts by weight to 60 parts by weight relative to 100 parts by weight of the binder resin. If the amount is not more than 20 parts by weight, toner-scattering tends to increase. If the amount is more than 60 parts by weight, toner charge cannot be stably secured, resulting in image quality degradation.

In the toner of the present invention, additive agents such as a charge-control agent and a mold-releasing agent may be added to its binder resin depending on various purposes. For example, for the charge-control agent, the following compounds may be added: a fluorine surface-active agent, a metal-containing dye such as a metal complex of salicylic acid and an azo-series metal compound, a high molecular acid such as a copolymer containing maleic acid as a monomer component, a quaternary ammonium salt, an azine dye such as nigrosine, carbon black, etc. Magnetic particles, etc. may also be added to the toner of the present invention, if necessary.

In the preparation of the toner of the present invention, above mentioned binder resin, coloring agent and, in addition, any desired additive are mixed together. The mixture is then kneaded and pulverized, the resulting particles being then classified to provide colored resin-particles. The colored resin-particles are mixed with inorganic fine particles which will be described hereinafter, and the mixture is then instantaneously heat-treated.

The colored resin-particles have a mean particle size of 4 to 10 μm, preferably 5 to 9 μm. The particle size distribution of particles obtained at this stage remains virtually unchanged even after instantaneous heat treatment of the particles.

The classifying process may be carried out after the instantaneous heating treatment of the present invention. It is preferable to use a granulator which allows the pulverized particles to have a spherical shape as a pulverizer used in the pulverizing process. The instantaneous heating treatment, which is to be carried out successively, can be controlled more easily. Examples of such a device include an Inomizer System (made by Hosokawa Micron K.K.), a Criptron System (made by Kawasaki Jyukogyo K.K.), etc. As a classifier used in the classifying process, it is preferable to use such a classifier as to allow the processed particles to have a spherical shape. This makes it easier to control the degree of roundness, etc. Examples of such a classifier include a Teeplex Classifier (made by Hosokawa Micron K.K.).

The instantaneous heating treatment of the present invention may be carried out in combination with various processes in surface-modifying devices for various developers. Examples of these surface-modifying devices include surface-modifying devices using the high-speed gas-flow impact method, such as Hybridization System (made by Narakikai Seisakusho K.K.), Criptron Cosmos System (made by Kawasaki Jyukogyo K.K.) and Inomizer System (made by Hosokawa Micron K.K.), surface-modifying devices using the dry mechanochemical method, such as Mechanofusion System (made by Hosokawa Micron K.K.) and Mechanomill (made by Okadaseikou K.K.), and surface-modifying devices in which the wet coating method is applied, such as Dispacoat (made by Nisshin Engineering K.K.) and Coatmizer (made by Freund Sangyo K.K.). And these devices may be used appropriately in a combined manner.

In the present invention, after colored fine resin-particles are mixed with inorganic fine particles, instantaneous heat treatment is carried out. Such mixing treatment of inorganic fine particles with colored resin-particles prior to instantaneous heat-treatment (hereinafter referred to as "pretreatment of inorganic fine particles") effect to improve the fluidity of the colored resin-particles and uniform particle-dispersion during the instantaneous heat-treatment. Further, through the pretreatment of inorganic fine particles, agglomeration of individual colored resin-particles during heat treatment can be prevented.

Examples of the above inorganic fine particles include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxide, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite. These materials may be used alone or in combination. For such inorganic fine particles, those having a BET specific surface area of 10 to 350 $m^2/g$ are usable.

From the view points of improvement of the fluidity of colored resin-particles and uniform dispersion of particles during instantaneous heat-treatment, inorganic fine particles having a BET specific surface area of 100 to 350 $m^2/g$, preferably 130 to 300 $m^2/g$ are used. It is preferable that the inorganic fine particles are subjected to a hydrophobic treatment with a known hydrophobicizer. A quantity of addition of the inorganic fine particles is 0.1 to 6 parts by weight, preferably 0.3 to 3 parts by weight relative to 100 parts by weight of colored resin-particles.

In order that inorganic fine particles may be present as spacers between individual colored resin-particles to prevent individual colored resin-particles from being agglomerated when the colored resin-particles are exposed to heat, inorganic fine particles for pre-treatment having a BET specific surface area of 10 to 100 $m^2/g$, preferably 20 to 90 $m^2/g$, more preferably 20 to 80 $m^2/g$ are used. A quantity of addition of the inorganic fine particles is 0.05 to 5 parts by weight, preferably 0.3 to 3 parts by weight, relative to 100 parts by weight of colored resin-particles.

In case that the inorganic fine particles for fluidity improvement and the inorganic fine particles for spacer are used in combination, it is desirable that the difference between the former and the latter in BET specific surface area is not less than 30 $m^2/g$, preferably not less than 50 $m^2/g$.

As above described, by carrying out instantaneous heat treatment after inorganic fine particles are mixed with colored resin-particles, it is possible to obtain toner particles with inorganic fine particles fixedly attached to the surface thereof and having a particular mean roundness and a roundness standard deviation which are to be described hereinafter.

In the present invention, the instantaneous heating treatment controls the colored resin-particles obtained through the kneading-pulverizing method so as to have a uniform spherical shape, reduces fine pores appearing on the surface of the toner, and increases smoothness. This makes it possible to provide a toner which is superior in uniformity in charging and in image-forming performance, eliminates phenomena such as selective developing in which toner having specific particle size, shape and ingredient in the developer and a specific quantity of charge is first consumed selectively, and achieves a stable image-forming performance for a long time.

Even when applied as a small-particle-size toner which contains as its main component a low-softening-point binder resin that is suitable for a high image-quality, low consumption (coloring material is highly-filled) and a low-energy fixing system, those properties being highly demanded in recent years, and which contains a coloring material at high filing-rate, the toner of the present invention exhibits an appropriate adhesive properties to the toner-supporting members (carrier, developing sleeves, developing roller), the photosensitive member and the transferring members, and also has a superior moving properties. Fluidity is excellent, uniformity in electrical charge is improved, and a stable durability is ensured for a long time. In the magnetic toner, by carrying out such instantaneous heat treatment the binder resin of magnetic particles is melted and made spherical, the magnetic particles exposed on the surface disappears, and liberated fine particles are fixed on the surface of magnetic particles.

Specifically, in the case of non-magnetic toner, an average degree of roundness is not less than 0.960, and standard deviation of roundness is not more than 0.040.

More preferably, the average degree of roundness is not less than 0.965, and the standard deviation of roundness is not more than 0.035. In the case of magnetic toner, the average degree of roundness is not less than 0.950, preferably not less than 0.955, and the standard deviation of roundness is not more than 0.040, preferably not more than 0.036.

In the present specification, the average degree of roundness, the average degree of roundness is an average value calculated by the following equation:

Average degree of roundness=Peripheral length of circle equal to projection area of a particle/Peripheral length of particle projection image In the present invention, with respect to the average degree of roundness, "Peripheral length of a circle equal to projection area of a particle" and "Peripheral length of a particle projection image" are represented by values obtained through measurements carried out by a flow-type particle image analyzer (EPIA-1000 or EPIA-2000; made by Toa Iyoudenshi K.K.) in an aqueous dispersion system. The closer the value to 1, the closer the shape to true sphericity. Since the average degree of roundness is obtained by "Peripheral length of a circle equal to projection area of a particle", and "Peripheral length of a particle projection image", the resulting value provides an index that correctly reflects the irregular conditions of the surfaces of particles. Since the average degree of roundness is a value obtained as an average value with respect to 3,000 particles, the reliability of the degree of roundness of the present invention is very high. Additionally, in the present description, the average degree of roundness is not necessarily measured by the above-mentioned apparatus, and any apparatus may be used as long as it is capable of carrying out the measurements based upon the above-mentioned equation in principle.

The standard deviation of the degree of roundness indicates a standard deviation in the distribution of the degree of roundness. This value is obtained together with the average degree of roundness at the same time by the above-mentioned flow-type particle image analyzer. The smaller the value, the more uniform the toner particle shapes.

The instantaneous heating treatment used in the present invention is carried out by spraying and dispersing toner particles into a hot air by using compressed air. The developer is surface-modified by heat. A high degree of roundness and homogeneity that have not been achieved by conventional methods can be achieved.

Figure 2:
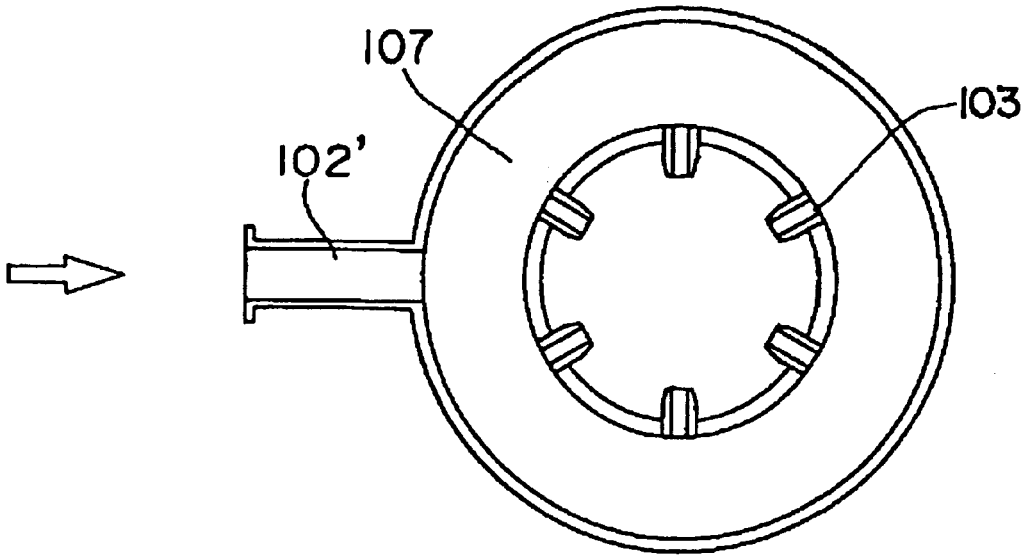
FIG. 2 is horizontal cross-sectional view that schematically shows sample-discharging chamber in the device of FIG. 1.

Referring to schematic views of FIGS. 1 and 2, the following description will discuss the construction of a device that carries out the instantaneous heating treatment.

As illustrated in FIG. 1, high-temperature, high-pressure air (hot air), formed in a hot-air generating device 101, is ejected by a hot-air jetting nozzle 106 through an induction pipe 102. Toner particles 105 are transported by a predetermined amount of pressurized air from a quantitative supplying device 104 through an induction pipe 102', and fed to a sample-ejecting chamber 107 installed around the hot-air ejecting nozzle 106.

As illustrated in FIG. 2, the sample-ejecting chamber 107 has a hollow doughnut shape, and a plurality of sample-ejecting nozzles 103 are placed on its inside wall with the same intervals. The toner particles, sent to the sample-ejecting chamber 107, are allowed to spread inside the ejecting chamber 107 in a uniformly dispersed state, and discharged through the sample-ejecting nozzles 103 into the hot air flow by the pressure of air successively sent thereto.

It is preferable to provide a predetermined tilt to the sample-ejecting nozzles 103 so as not to allow the discharging flow from each sample-ejecting nozzle 103 to cross the hot air flow. More specifically, the ejection is preferably made so that the toner-ejecting flow runs along the hot air flow to a certain extent. An angle formed by the toner ejecting flow and the direction of the central flow of the hot air flow is preferably set in the range of 20 to 40°, preferably 25 to 35°. The angle wider than 40° causes the toner ejecting flow to cross the hot air flow, resulting in collision with toner particles discharged from other nozzles and the subsequent aggregation of the toner particles. The angle narrower than 20° left some toner particles not being taken in the hot air flow, resulting in irregularity in the toner particle shape.

A plurality of the sample-ejecting nozzles 103, preferably at least not less than 3, more preferably not less than 4 are required. The use of a plurality of the sample-ejecting nozzles makes it possible to uniformly disperse the toner particles into the hot air flow, and to ensure a heating treatment for each of the toner particles. With respect to the ejected state from the sample-ejected nozzle, it is desirable that the toner particles are widely scattered at the time of ejection and dispersed to the entire hot air flow without collision with other toner particles.

The toner particles, thus ejected, are allowed to contact with the high-temperature hot air instantaneously, and subjected to a heating treatment uniformly. "Instantaneously" refers to a time period during which a required toner-particle improvement (heating treatment) has been achieved without causing aggregation between the toner particles; and although it depends on the processing temperature and the density of toner particles in the hot air flow, this time period is normally set at not more than 2 seconds, preferably not more than 1 second. This instantaneous time period is represented as a residence time of toner particles from the time when the toner particles are ejected from the sample-ejecting nozzles to the time when they are transported into the induction pipe 102". The residence time exceeding 2 seconds is likely to cause bonding of particles.

The toner particles, which have been instantaneously heated, are cooled off by a cold air flow introduced from a cooling-air induction section 108, and collected into a cyclone 109 through-the induction pipe 102" without adhering to the device walls and causing aggregation between particles, and then stored in a production tank 111. The carrier air from which the toner particles have been removed is allowed to pass through a bug filter 112 by which fine powder is removed therefrom, and released into the air through a blower 113. The cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the induction pipe 102' by the pressurized air. Although it also depends on other conditions, the amount of dispersing air is preferably suppressed during the heating treatment. Dispersing state of toner particles are improved and stabilized.

The dispersion density refers to a dispersion density of toner particles in a heating treatment area (more specifically, a nozzle-jetting area). A preferable dispersion density varies depending on the specific gravity of toner particles; and the value obtained by dividing the dispersion density by the specific gravity of toner particles is preferably set in the range of 50 to 300 g/m$^3$, preferably 50 to 200 g/m$^3$.

The processing temperature refers to a temperature within the heating treatment area. In the heating treatment area, a temperature gradient spreading outwards from the center actually exists, and it is preferable to reduce this temperature distribution at the time of the heating treatment. It is preferable from the viewpoint of device mechanism to supply an air flow in a stable layer-flow state by using a stabilizer, etc. In the case of a non-magnetic toner containing a binder resin having a sharp molecular-weight distribution, for example, a binder resin having a ratio of weight-average molecular weight/number-average molecular weight of 2 to 20, it is preferable to carry out the heating treatment in a peak-temperature range between the glass transition point of the binder resin+100° C. and the glass transition point thereof +300° C. It is more preferable to carry it out in a peak-temperature range between the glass transition point of the binder resin +120° C. and the glass transition point thereof +250° C. The peak temperature range refers to a maximum temperature in the area in which the toner contacts with the hot air.

In the case of a non-magnetic toner containing a binder resin having a relatively wide molecular-weight distribution, for example, a binder resin having a ratio of weight-average molecular weight/number-average molecular weight of 30 to 100, it is preferable to carry out the heating treatment in a peak-temperature range between the glass transition point of the binder resin +100° C. and the glass transition point thereof +300° C. It is more preferable to carry it out in a peak-temperature range between the glass transition point of the binder resin +150° C. and the glass transition point thereof +280° C. The reason for this is that, in order to improve the shape and surface homogeneity of the toner, it is necessary to apply a high processing temperature so that even the high molecular portion of the binder resin can be modified. However, the setting of the high processing temperature, in contrast, tends to produce bonded particles; therefore, some adjustment of conditions may be required. For example, an amount of a fluidizing agent prior to the heating treatment has to be set higher, or the dispersion density is set lower at the time of the treatment, etc.

When wax is added to the toner particles, particles are more likely to bond. For this reason, some adjustment of conditions may be required. For example, an amount of a fluidizing agent (especially, fluidizing agent having a large particle size) prior to the heating treatment is set higher. The dispersion density is set lower at the time of the treatment, etc. These adjustments are significant to obtain uniform toner particles with shape-irregularity suppressed. These operations are particularly important when a binder resin having a relatively wide molecular weight distribution is used or when the processing temperature is set to a high level in order to heighten the degree of roundness.

The cooling air temperature refers to a temperature of cold air introduced from the cooling-air introduction section 108. The toner particles, after having been subjected to an instantaneous heating treatment, are preferably placed in an atmosphere of a temperature not more than the glass transition point by using cold air so as to be cooled to a temperature range which causes no aggregation or bonding of the toner particles. Therefore, the temperature of the cooling air is set at not more than 25° C., preferably not more than 15° C., more preferably not more than 10° C. However, an excessively lowered temperature might cause dew condensation in some conditions and adverse effects; this must be noted. In the instantaneous heating treatment according to the invention, together with a cooling effect by cooling water in the device as will be described next, since the time in which the binder resin is in a fused state is kept very short, it is possible to eliminate aggregation between the particles and adhesion of the particles to the device walls of the heat treatment device. Consequently, it becomes possible to provide superior stability even during continuous production, to greatly reduce the frequency of cleaning for the manufacturing devices, and to stably maintain the yield high.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket installed in the cyclones 109 and 114 and in the induction pipe 102". The temperature of cooling water is set at not more than 25° C., preferably not more than 15° C., more preferably not more than 10° C.

In order to maintain a high degree of sphericity (degree of roundness) and to reduce irregularity in shape, it is preferable to further take the following measures.

(1) The amount of toner particles to be supplied to the hot air flow is kept constant without generating pulsating movements, etc. For this purpose;

(i) a plurality of devices, such as a table feeder 115 shown in FIG. 1 and a vibration feeder, are used in combination so as to improve the quantitative supplying properties. If a high-precision quantitative supply is achieved by using a table feeder and a vibration feeder, finely-pulverizing and classifying processes can be connected thereto so that toner particles can be supplied on-line to the heating treatment process;

(ii) After having been supplied by compressed air, prior to supplying toner particles into hot air, the toner particles are re-dispersed inside the sample-supplying chamber 107 so as to enhance the dispersion uniformity. For example, the following measures are adopted: the re-dispersion is carried out by using secondary air; the dispersed state of the toner particles is uniformed by installing a buffer section; and the re-dispersion is carried out by using a co-axial double tube nozzle, etc.

(2) When sprayed and supplied into a hot air flow, the dispersion density of the toner particles is optimized and controlled uniformly.

For this purpose;

(i) the supply into the hot air flow is carried out uniformly, in a highly dispersed state, from all circumferential directions. More specifically, in the case of supply from dispersion nozzles, those nozzles having a stabilizer, etc. are adopted so as to improve the dispersion uniformity of the toner particles that are dispersed from each of the nozzles;

(ii) In order to uniform the dispersion density of the toner particles in the hot air flow, the number of nozzles is set to at least not less than 3, preferably not less than 4, as described earlier. The greater the number, the better, and these nozzles are arranged symmetrically with respect to all the circumferential directions. The toner particles may be supplied uniformly from slit sections installed all the 360-degree circumferential areas;

(3) Control is properly made so that no temperature distribution of the hot air is formed in the processing area of toner particles so as to apply uniform thermal energy to each of the particles, and the hot air is maintained in a layer-flow state.

For this purpose;

(i) the temperature fluctuation of a heating source for supplying hot air is reduced.

(ii) A straight tube section preceding the hot-air supplying section is made as long as possible. Alternatively, it is preferable to install a stabilizer in the vicinity of the hot-air supplying opening so as to stabilize the hot air. Moreover, the device construction, shown in FIG. 1 as an example, is an open system; therefore, since the hot air tends to be dispersed in a direction in which it contacts with outer air, the supplying opening of the hot air may be narrowed on demands.

(4) The collection of the heat-treated product is controlled so as not to generate heat.

For this purpose;

(i) the particles that are subjected to the heat treatment and cooling process are preferably cooled in a chiller in order to reduce heat generating in the piping system (especially, in R portions) and in the cyclone normally used in the collection of the toner particles.

(5) In the case of a process using magnetic toner having a relatively greater specific gravity with a small amount of resin component that contributes to the heating treatment, it is preferable to surround the heat-treating space in a cylinder shape so as to increase the time during which the treatment is virtually carried out, or to carry out a plurality of the treatments.

The toner particles obtained above are admixed externally with a post-treating agent such as a fluidizing agent. The following inorganic fine particles or organic fine particles may be used as the post-treating agent.

Examples of the inorganic fine particles include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxide, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite. These materials may be used alone or in combination. In particular, it is preferable that the inorganic fine particles such as silica, titanium oxide, alumina and zinc oxide are treated by a known method with a conventionally used hydrophobisizing agent, such as a silane coupling agent, a titanate coupling agent, silicone oil and silicone vanish, or with a treatment agent, such as a fluorine silane coupling agent or fluorine silicone oil, a coupling agent having an amino group or a quaternary aluminum salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used. These organic fine particles also works as a cleaning-assist agent.

Inorganic fine particles, such as titanate metal salts, having a comparatively large particle size, and various organic fine particles may be, or may not be subjected to a hydrophobic treatment. An amount of addition of these fluidizing agents is from 0.1 to 5% by weight, preferably 0.5 to 3% by weight to toner particles. It is preferable to properly adjust the amount in relation with inorganic fine particles for pre-treatment.

With respect to the post-treating agents, it is preferable to use inorganic fine particles having a BET specific surface area of 1 to 350 $m^2/g$.

In order to improve the fluidity of the toner, it is preferable to use those having a BET specific surface area of 100 to 350 $m^2/g$, preferably 130 to 300 $m^2/g$, as the inorganic fine particles for post-treatment. These inorganic fine particles are preferably subjected to a hydrophobic treatment by a known hydrophobic agent. An amount of addition of the inorganic fine particles is in the range between 0.1 and 3% by weight, preferably 0.3 and 1% by weight with respect to the toner particles.

In order to improve the toner's environmental stability and endurance stability, those having a BET specific surface area of 1 to 100 $m^2/g$, preferably 5 to 90 $m^2/g$, more preferably 5 to 80 $m^2/g$ are used as the inorganic fine particles for the post-treatment. An amount of addition of the inorganic fine particles is set to 0.05 to 5% by weight, preferably 0.3 to 2% by weight, with respect to the toner particles.

In the case when the inorganic fine particles for improving fluidity and the inorganic fine particles for improving stability are used in combination, the difference between the BET specific surface areas of the two is adjusted to not less than 30 $m^2/g$, preferably not less than 50 $m^2/g$.

When the colored resin-particles pre-treated as above mentioned are dispersed and sprayed into hot air so as to be subjected to an instantaneous heating treatment in a manner as described above and the obtained toner particles are mixed with the post-treating agent, the resultant color toner and oil-less fixing toner have surface characteristics that satisfy the following formula [I]:

$$D/d_{50} \geqq 0.40, \text{ where } D=6/(\rho \cdot s) \quad [I]$$

(in the formula [I], D represents a converted particle size ($\mu$m) from the specific surface area obtained when it is supposed that the toner shape is spherical; $d_{50}$ is a particle size ($\mu$m) corresponding to 50% of the relative weight distribution classified by particle sizes (weight-average particle size); $\rho$ is a true density of toner ($g/cm^3$); and S is a BET specific surface area ($m^2/g$)). $D/d_{50}$ is preferably set in the range of 0.40 to 0.80, preferably from 0.50 to not less than 0.70.

In the case of magnetic toner, since magnetic particles are included inside the particles, the lower limit value of $D/d_{50}$ is set as compared with that of particles not containing magnetic particles, and those having a value of $D/d_{50} \geqq 0.20$ are used. The preferable range of $D/d_{50}$ is from 0.20 to 0.55, more preferably 0.25 to 0.50.

The value of $D/d_{50}$ is an index which indicates surface conditions of toner particles. When the particles have an above value, the toner surface has less pores and there will not occur such a problem as toner particle-cracking, and suitable convex portions for enhancing toner chargeability are formed in the process of pretreatment or after-treatment.

With respect to the BET specific surface area, values measured by Flow Sorb 2,300 (made by Simazu Seisakusho K.K.) are used. However, the measuring device is not limited by this, and any device may be used as long as the measurements are carried out in the same measuring principle and method.

The weight-average particle size ($d_{50}$) used in the present invention is a value measured by Coulter Multisizer II (made by Coulter Counter K.K.). However, the measuring device is not limited by this, and any device may be used as long as the measurements are carried out in the same measuring principle and method.

With respect to the true density ρ, which means the one of toner, values measured by "an air-comparative specific gravity meter" (made by Beckman K.K.) are used. However, the measuring device is not limited by this, and any device may be used as long as the measurements are carried out in the same measuring principle and method.

Carrier

Instantaneous heat treatment used in the preparation of toner can be also used in the preparation of carrier particles and can control the shape of particles to uniform and spherical shape, being thus able to provide carrier particles having non-porous, smooth, uniform surface characteristics.

Specifically, it is possible to obtain carrier particles having an average degree of roundness of not less than 0.940 and a standard deviation of degree of roundness of not more than 0.055.

Such a carrier can quickly and uniformly mix with a spherical toner and enables uniform electrical charging. The carrier effectively functions to build up toner charge and restrain toner scatterring and duplicates fog-free high quality copy-images through best use of the advantage of small-size, spherical toner particles. Further, since the carrier is spherical in shape and has less porous and highly smooth surface configuration, the carrier has wider tolerance limits of carrier development control and can enhance development efficiency. Further, the carrier has good anti-spent properties against toner component. Furthermore, the carrier is usable when used as a recycling developer agent.

The carrier particles including at least binder resin and magnetic particles which are passed through the steps of mixing, kneading, pulverizing, and classifying, are subjected to the same heat treatment as described for the preparation of toner. The classifying process may be carried out after the heat treatment. In the treatment of a binder-type carrier which contains a little amount of resin component contributive to heat treatment and has comparatively large specific gravity, it is desirable that the space in which heat treatment is carried out is cylindrically enclosed to increase the time period virtually spent for treatment, or treatment is carried out plural times.

The carrier is finally produced so that the carrier has a weight-mean particle size of 20 to 70 μm, an average degree of roundness of not less than 0.940, and a standard deviation of degree of roundness of not more than 0.055, more preferably having not less than 0.004 in terms of $D/d_{50}$ and, in addition, a magnetic force of 900 to 3,000 Gauss (in Oe magnetic field of 1,000), preferably 1,800 to 2,800 Gauss, and a true specific gravity of 5 or less.

For the binder resin to be used in the preparation of carrier, any known synthetic resin and natural resin. Specifically, styrene resins, acrylic resins, olefin resins, diene resins, polyester resins, polyamide resins, epoxy resins, silicone resins, phenolic resins, petroleum resins, and urethane resins are exemplified as such synthetic and natural resins. Among those resins, polyester resins are preferred which have high dispersion capability with respect to magnetic particles and are less susceptible to electric resistance drop when magnetic particle loading is increased. Further, from the standpoint of use for electrophotographic development, it is preferable that the binder resin has a glass transition point of not less than 50° C., preferably not less than 60° C., and a softening point of 80 to 150° C. If the softening point is less than 80° C., carrier particles are liable to aggregation, so that dispersion at the stage of heat treatment is difficult. As a result, the standard deviation of degree of roundness cannot be controlled to a value of not more than 0.04. When the temperature exceeds 150° C., it is not possible to control the average degree of roundness to not less than 0.950, the value of which is one of the requirements of the present invention. Moreover, it is not possible to satisfy the range of values, $D/d_{50} \geqq 0.004$, which is required for improving the durability and carrier-developing characteristics.

In the case when $D/d_{50}$ is smaller than 0.004, neither a sufficient permissible range for restriction of carrier development, nor a sufficient anti-spent properties against toner, can be maintained.

The carrier particle size closely relates to improvements of electrification-build-up properties, charging stability and toner scattering. Neither an average particle size of less than 20 μm nor that of more than 70 μm fails to exhibit sufficient effects. In the present invention, it is preferable to use those carriers having an average particle size of not more than 60 μm, preferably not more than 50 μm. In order to achieve a uniform surface-modifying treatment in an instantaneous heating process, the use of carrier particles having the above-mentioned particle size is preferable to achieve the developer of the present invention, in addition to optimizing the conditions of the fluidizing process prior to the surface-modifying treatment and the instantaneous heating process, in the same manner as the other processes for the developer.

When placed in a magnetic field having a magnetic force 1,000 Oe, the carrier particles having less than 900 gauss cause carrier developing and degradation in copied-images. The carrier particles having more than 3,000 gauss make a magnetic brush so hard that carrier lines are formed in a solid portion, etc. The present invention makes it possible to widen the permissible range to noise generation, as compared with conventional carriers. In particular, conventionally, the condition of use in a range not less than 2,500 gauss tends to cause carrier lines in a solid portion, etc. However, the carrier, which is subjected to the surface-modifying treatment of the present invention, makes it possible to maintain the magnetic brush softer due to the effects of its shape and surface characteristics, even though it has the above-mentioned physical properties.

With respect to the specific gravity, the carrier having a true specific gravity of not more than 5 is preferable from the viewpoint of mixing and stirring properties and improvements for aggregation of the developer. The true specific gravity of greater than 5 makes the difference in specific gravity between the toner and carrier greater, causing degradation in the mixing and stirring properties, as well as causing excessive stress on the toner, with the result that the withstand-voltage stability is reduced due to spent carrier and aggregation between toner particles as well as between developer particles (toner and carrier) is accelerated. The carrier of the present invention is effective for reducing stress on the toner as well as for reducing the aggregation between toner particles as well as between developer particles (toner and carrier) due to its shape and surface characteristics. However, when making the carrier particles uniform by using the instantaneous heating process of the present invention, it is preferable to use carrier particles having a specific gravity of not more than 5 in addition to optimizing the conditions of the fluidizing process prior to the surface modifying treatment and the instantaneous heating process, in the same manner as the other processes for the developer. The true specific gravity exceeding 5 makes it difficult to secure uniform shape and surface characteristics which are the effects of the present invention. This is because a greater specific gravity makes a relative composition of the resin component existing on the carrier surface smaller, thereby reducing the component to be modified through the heating treatment. When the true specific gravity is greater than 5, the time during which the particles are allowed to pass through the heat-treatment region is shortened, making it difficult to sufficiently secure an effective treatment time required for the heating treatment for the carrier particles.

Examples of Production of Resins

Production Examples of Polyester Resins A to E

To a four-necked flask equipped with a thermometer, a stainless stirring stick, a dropping-type condenser and a nitrogen gas inlet tube were loaded an alcohol component and an acid component at a specific ratio as shown in Table 1, together with a polymerization initiator (dibutyltinoxide). This flask was put on a mantle heater. The ingredients were heated while being stirred under a nitrogen gas flow to react. The progress of the reaction was followed by measuring its acid value. At the time of reaching a predetermined acid value, the reaction was finished. The contents were cooled to room temperature. Thus, a polyester resin was obtained. Each polyester resin obtained was coarsely pulverized into not more than 1 mm, and used in producing toners which will be described later. The polyester resins thus obtained had physical properties ssuch as a number-average molecular weight (Mn), a ratio of weight-average molecular weight (Mw)/number-average molecular weight (Mn), a glass transition point (Tg), a softening point (Tm), an acid value and a hydroxide value as shown in Table 1.

In Table 1, "PO" means polyoxypropylene(2,2)-2,2-bis(4-hydroxyphenyl)propane, "EO" means polyoxyethylene (2,0)-2,2-bis(4-hydroxyphenyl)propane, "GL" means glycerin, "TPA" means telephthalic acid and "FA" means fumaric acid.

TABLE 1

| Polyester | Alcohol Component | | | Acid Component | | | | | Tg | Tm | Acid Value | Hydroxyl Value |
|---|---|---|---|---|---|---|---|---|---|---|---|---|
| Resin | PO | EO | GL | FA | TPA | TMA | $M_n$ | $M_w/M_n$ | (° C.) | (° C.) | (KOHmg/g) | (KOHmg/g) |
| A | 4.0 | 6.0 | — | — | 9.0 | — | 3300 | 4.2 | 68.5 | 110.3 | 3.3 | 28.1 |
| B | 3.5 | 6.0 | 0.5 | — | 9.0 | — | 3400 | 4.5 | 64.8 | 115.2 | 4.9 | 23.0 |
| C | 5.0 | 5.0 | — | 5.0 | 4.0 | — | 3800 | 3.0 | 68.3 | 102.8 | 3.8 | 28.7 |
| D | 3.0 | 7.0 | — | — | 7.0 | 2.0 | 2800 | 2.3 | 59.5 | 101.8 | 1.3 | 60.4 |
| E | 2.5 | 7.5 | — | 7.5 | 5.0 | — | 5200 | 4.3 | 61.0 | 99.5 | 24.9 | 19.1 |

The physical properties shown in Table 1 were measured as follows.

Measurements of the glass transition point Tg

The glass transition point Tg of the resin was measured by a differential scanning calorimeter (DSC-200: made by Seiko Denshi K.K.) in which: based upon alumina as the reference, 10 mg of a sample was measured under the conditions of a temperature-rise rate of 10° C./min and at temperatures ranging from 20 to 120° C. The shoulder value of the main endothermic peak was defined as the glass transition point.

Measurements of the softening point Tm

The softening point Tm of resin was measured by Flow Tester (CFT-500; made by Shimadzu Seisakusho K.K). A sample (1 $cm^3$) was fused and flowed under the following conditions; pore of die (diameter 1 mm, length 1 mm), a pressure of 20 $kg/cm^2$ and a temperature-rising rate of 6° C./min. Temperature corresponding to a ½ of the height from the flow-out start point to the flow-out completion point was taken as a softening point.

Measurements of the molecular weight

The molecular weight was measured by a gel permeation chromatography (807-IT Type: Nippon Bunko Kogyo K.K.) using tetrahydrofuran as a carrier solvent based upon polystyrene conversion.

Acid value

With respect to the acid value, 10 mg of a sample was dissolved in 50 ml of toluene, and this was titrated by a standardized solution of N/10 potassium hydroxide/alcohol in the presence of an indicator of 0.1% of bromo-thymol blue and phenol red. The acid value was calculated from the amount of consumption of the solution of N/10 potassium hydroxide/alcohol.

Hydroxide value

With respect to the hydroxide value, a weighed sample was treated by acetic anhydride, and an acetyl compound thus obtained was subjected to hydrolysis so that the number of mg of potassium hydroxide required for neutralizing isolated acetic acid was taken.

Production Example of Polyester Resin F (L-type)

Into a four-knecked glass flask equipped with a thermometer, a stirrer, a dropping-type condenser and a nitrogen gas inlet pipe were put polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid and fumaric acid so as to be adjusted at a weight ratio of 82:77:16:32:30, together with dibutyl tin oxide as a polymerization initiator. This flask was placed on a mantle heater for heating to react while being stirred at 220° C. under a nitrogen gas atmosphere. A polyester resin F (L-type) thus obtained had a softening point of 110° C., a glass transition point of 60° C. and an acid value of 17.5 KOH mg/g.

Production Example of Polyester Resin G (H-type)

Styrene and 2-ethylenehexyl acrylate were adjusted to a weight ratio of 17:3.2, and placed in a dropping funnel together with dicumylperoxide as a polymerization initiator.

Into a four-kneck glass flask equipped with a thermometer, a stirrer, a dropping-type condenser and a nitrogen gas inlet pipe were put polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid, 1,2,4-benzenetricarboxylic acid anhydride and acrylic acid so as to be adjusted at a weight ratio of 42:11:11:11:8:1, together with dibutyl tin oxide as a polymerization initiator. This flask was placed on a mantle heater. The solution was stirred at 135° C. under a nitrogen gas atmosphere, with styrene, etc. being dropped therein from the dropping funnel, and then heated to 230° C. at which reaction was carried out. A polyester resin G (H-type) thus obtained had a softening point of 150° C., a glass transition point of 62° C. and an acid value of 24.5 KOH mg/g.

EXAMPLES

Preparation of pigment master batch

With respect to pigments used in the preparation of the following full-color toners, each of polyester resins used in examples and each of C.I. Pigment Yellow 180 (made by Crarient K.K.), C.I. Pigment Blue 15-3 (made by Dainippon Ink Kagaku K.K.) or C.I. Pigment Red 184 (made by Dainippon Ink Kagaku K.K.) were loaded into a pressure kneader at a weight ratio of 7:3, and kneaded at 120° C. for one hour. After cooled off, the kneaded material was coarsely pulverized by a hammer mill to give pigment master batches of yellow, cyan and magenta having a pigment content of 30 wt %.

Production Examples of Toner

Full-color Toners

Production Examples Y-1 and Y-2

To 90.7 parts by weight of polyester resin A obtained in the production example of resin were added 13.3 parts by weight of the yellow master batch, 2.0 parts by weight of a zinc complex of salicylic acid (E-84; made by Orient Kagaku Kogyo K.K.) as a charge-control agent and oxidized-type low molecular weight polypropylene (100TS; Sanyo Kasei Kogyo K.K.: softening point 140° C., acid value 3.5). This mixture was sufficiently mixed in Henschel Mixer, and then fused and kneaded by a twin screw-extruding kneader (PCM-30; made by Ikegai Tekkou K.K.) whose discharging section was detached, and then cooled. The kneaded matter thus obtained was pressed and extended to a thickness of 2 mm by a cooling press roller, and cooled off by a cooling belt, and then roughly pulverized by a feather mill. The pulverized material was pulverized by a mechanical granulator (KTM: made by Kawasaki Jyukogyo K.K.) to an average particle size of 10 to 12 $\mu$m, and further pulverized and coarsely classified to an average particle size of 6.8 $\mu$m by Jet mill (IDS: made by Nippon Pneumatic MFG), and then finely classified by a rotor-type classifier (Teeplex classifier Type: 100 ATP; made by Hosokawa Micron K.K.), with the result that yellow toner particles (Y-1) having the following measurements were obtained: the weight-average particle size; 7.1 $\mu$m, particles having not less than two times ($2d_{50}$) the weight-average particle size ($d_{50}$) of 0.1 weight %; and particles having not more than ⅓ ($d_{50}/3$) the weight-average particle size of 3.2% by number. The present toner particles (Y-1) had an average degree of roundness of 0.943 and a standard deviation of the degree of roundness of 0.039.

To 100 parts by weight of the toner particles (Y-1) were added 0.5 parts by weight of hydrophobic silica (TS-500: made by Cabosil K.K., BET specific surface area 225 $m^2/g$) and 1.0 part by weight of hydrophobic silica (AEROSIL 90G (made by Nippon Aerosil K.K.) subjected to a modifying treatment with hexamethylenedisilazane; BET specific surface area 65 $m^2/g$, degree of hydrophobicity; not less than 65%). The mixture was was mixed by Henschel Mixer (peripheral speed 40 m/sec, for 60 seconds), and then subjected to a surface-modifying treatment by heat under the following conditions by means of an instantaneous heating device having a structure as shown in FIG. 1. Thus, yellow toner particles (Y-2) was obtained.

Thermal Treatment Condition 1

Developer supplying section; Table feeder+vibration feeder

Dispersing nozzle; Four (Symmetric layout with 90 degrees respectively to all circumference)

Ejecting angle; 30 degrees

Amount of hot air; 800 L/min

Amount of dispersing air; 55 L/min

Amount of suction air; −1200 L/min

Dispersion density; 100 $g/m^3$

Processing temperature; 250° C.

Residence time; 0.5 second

Temperature of cooling air; 15° C.

Temperature of cooling water; 10° C.

To these toner particles were respectively added 0.5% by weight of hydrophobic silica fine particles (R-972; made by Nippon Aerosil K.K.) having a BET specific surface area of 110 $m^2$ and 0.5% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 $\mu$m to give toners that were to be used in evaluation.

Examples of Production Y-3 Through Y-5

The same method and compositions as example of production for toner Y-2 were carried out except that the temperature conditions of the thermal treatment were respectively changed to 150° C., 200° C. and 300° C.; thus, yellow toners (Y-3 through Y-5) were obtained.

Figure 6:
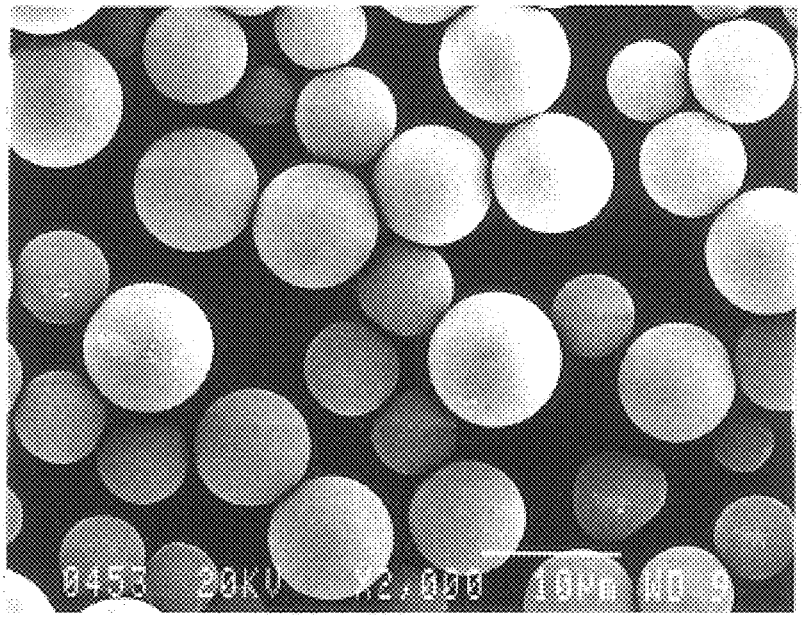
FIG. 6 is a duplicate of photography of particle structure of toner particles (Y-5).
Figure 7:
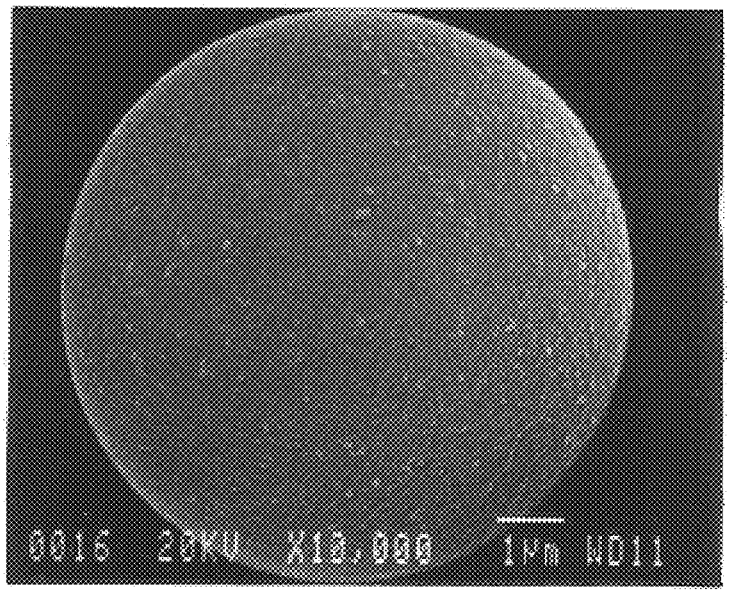
FIG. 7 is a duplicate of photography of particle structure of toner particles (Y-5).

With respect to yellow toner particles Y-5, FIGS. 6 and 7 are copies of photographs showing the structure of its toner particles. FIG. 6 shows structures of a plurality of toner particles. FIG. 7 shows an enlarged particle structure of the surface of one of the particles. Electronically copied photographs of these photographs were submitted as reference photographs upon filing the present application.

Example of Production Y-6

The same method and compositions as example of production for toner Y-2 were carried out except that resin A was changed to resin B without adding oxidized type polypropylene. Thus, toner (Y-6) was obtained.

Example of Production Y-7

The same method and compositions as example of production for toners Y-6 were carried out except that, instead of resin B, resin C and resin D were mixed at a ratio of 20:80. Thus, toner (Y-7) was obtained.

Example of Production Y-8

The same method and compositions as example of production for toners Y-7 were carried out except that, instead of resin B, resin C and resin G were mixed at a ratio of 85:15. Thus, toner (Y-8) was obtained.

Examples of Production C-1 Through C-8 and M-1 Through M-8

The same methods and compositions as the above examples were carried out except that the master batches were respectively changed to those of cyan and magenta pigments. Thus, toners C-1 through C-8 and M-1 through M-8 were obtained.

Example of Production Bk-1 and Bk-2

The same methods and compositions as examples of production for toners 1 and 2 were carried out except that the amount of polyester resin A was changed to 100 parts by weight and that the pigment master batch was changed to 4 parts by weight of carbon black (Mogul L; made by Cabot K.K.) to give toners Bk-1 and Bk-2.

Example of Production Y-9

To 89.5 parts by weight of polyester resin A were added 15 parts by weight of the master batch of yellow pigment, 1 part by weight of a boron compound represented by the following chemical formula and 400 parts by weight of toluene. This mixture was mixed in an ultrasonic homogenizer (output 400 $\mu$A) for 30 minutes for dissolution and dispersion to give a colored resin solution.

(A)

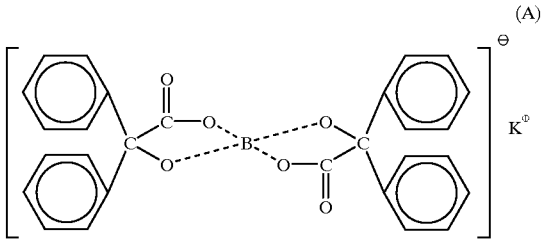

Meanwhile, to 1,000 parts by weight of an aqueous solution containing 4% by weight of calcium phosphate hydroxide as a dispersion stabilizer was dissolved 0.1 part by weight of lauryl sodium sulfate (made by Wako Jyunyaku K.K.) so that an aqueous dispersion solution was prepared. To 100 parts by weight of this aqueous dispersion solution was dropped 50 parts by weight of the above colored resin solution while being stirred at 4,200 rpm by TK Auto Homo Mixer (made by Tokushu Kika Kogyo K.K.), with the result that liquid droplets of the colored resin solution was suspended in the aqueous dispersion solution. This suspended solution was left for 5 hours under the conditions of 60° C. and 100 mmHg so that toluene was removed from the liquid droplets and colored resin particles were deposited. Then, calcium phosphate hydroxide was dissolved with concentrated sulfuric acid. The deposited particles were subjected to repeated filtration/washing processes. Thereafter, the colored particles were dried at 75° C. by a slurry drying device (Dispacoat (made by Nisshin Engineering K.K.). Thus, yellow toner particles (Y-9) were obtained.

To these toner particles were respectively added 0.5% by weight of hydrophobic silica fine particles (R-972; made by Nippon Aerosil K.K.) having a BET specific surface area of 110 $m^2$ and 0.5% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 $\mu$m to give toner.

Examples of Production C-9 and M-9

The same methods and compositions as example of production for toner particles (Y-9) were carried out except that the master batches were respectively changed from yellow to those of cyan and magenta pigments. Thus, toner particles (C-9 and M-9) were obtained.

Example of Production Y-10

To 100 parts by weight of the toner particles (Y-1) was added 1.0 part by weight of hydrophobic silica (RX-200: made by Nippon Aerosil K.K.; BET specific surface area 140 $m^2/g$). The mixture was mixed by Henschel Mixer (peripheral speed 40 m/sec, for 180 seconds), and then subjected to a surface-modifying treatment by heat under the following conditions by using an instantaneous heating device having a structure as shown in FIG. 1. Thus, yellow toner particles (Y-10) were obtained.

(Thermal treatment condition 2)

Developer supplying section; Table feeder

Dispersing nozzle; Two (Symmetric layout with respect to all circumference)

Ejecting angle; 45 degrees

Amount of hot air; 620 L/min

Amount of dispersing air; 68 L/min

Amount of suction air; −900 L/min

Dispersion density; 150 $g/m^3$

Processing temperature; 250° C.

Residence time; 0.5 second

Temperature of cooling air; 30° C.

Temperature of cooling water; 20° C.

To these toner particles were added 0.5% by weight of hydrophobic silica fine particles (R-972; made by Nippon Aerosil K.K.) having a BET specific surface area of 110 $m^2$ and 0.5% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 $\mu$m to give toner.

Examples of Production Y-11 Through Y-13

The same method and compositions as example of production for toner Y-10 were carried out except that the temperature conditions of the thermal treatment were respectively changed to 150° C., 200° C. and 300° C. Thus, yellow toner particles (Y-11 through Y-13) were obtained.

Figure 8:
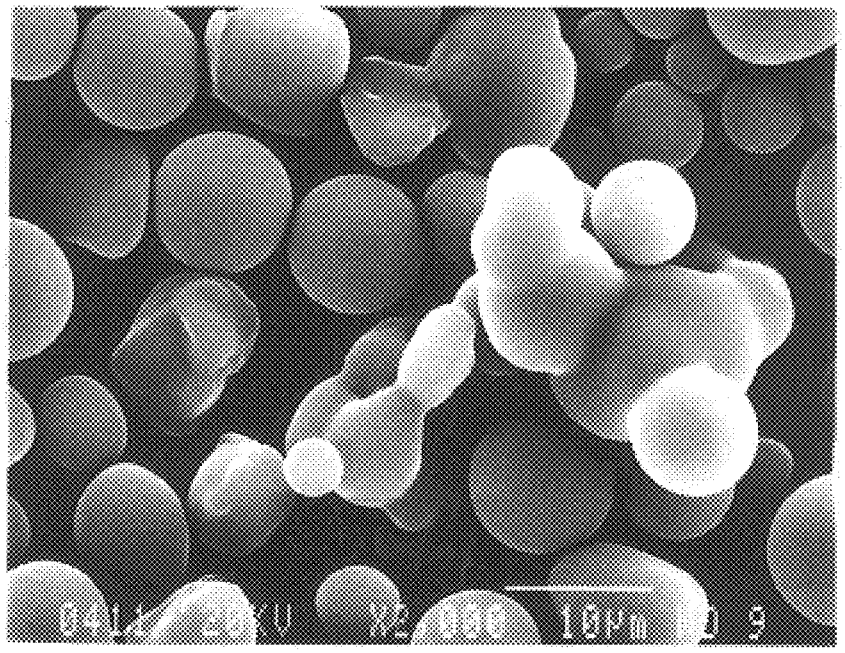
FIG. 8 is a duplicate of photography of particle structure of toner particles (Y-13).
Figure 9:
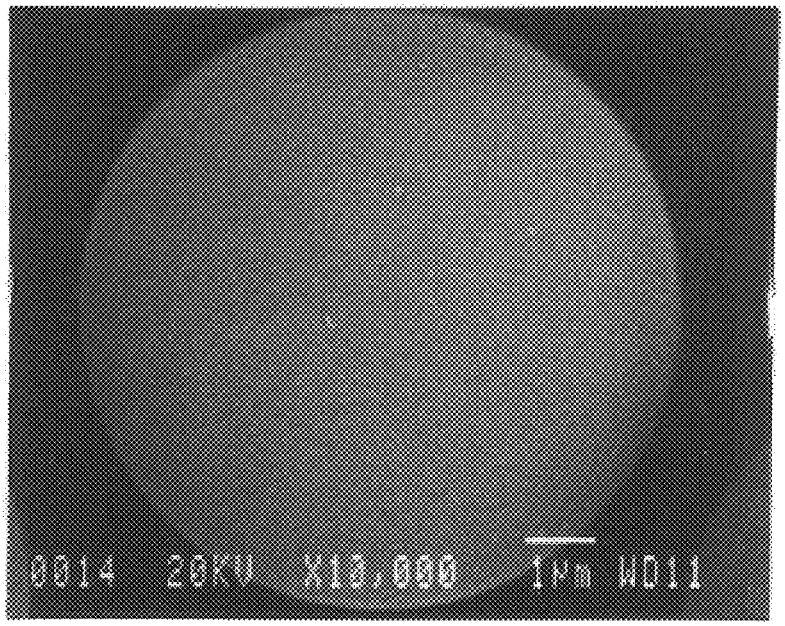
FIG. 9 is a duplicate of photography of particle structure of toner particles (Y-13).

With respect to yellow toner particles Y-13, FIGS. 8 and 9 are copies of photographs showing the structure of its toner particles. FIG. 8 shows structures of a plurality of toner particles. FIG. 9 shows an enlarged particle structure of the surface of one of the particles.

Examples of Production C-10 to 13 and M-10 to 13

The same methods and compositions as examples of production for toners Y-10 to 13 were carried out except that the master batch was changed to those of cyan and magenta pigments. Thus, toners C-10 to 13 and M-10 to 13 were obtained.

Examples of Production Bk-3 to 5

The same method and compositions as example of production for toner Bk-2 were carried out except that the temperature conditions of the thermal treatment were respectively changed to 150° C., 250° C. and 300° C. Thus, toners (Bk-3 to 5) were obtained.

Example of Production Bk-6 to Bk-9

The same method and compositions as example of production for toner Bk-2 were carried out except that the conditions of thermal treatment were changed to those of examples of production for toners Y-10 to Y-13. Thus, toners Bk6 to Bk9 were obtained.

Example of Production Bk-10

The same methods and compositions as example of production for toner Y-9 were carried out except that the amount of polyester resin A was changed to 100 parts by weight and that the pigment master batch was changed to 4 parts by weight of carbon black (Mogul L; made by Cabot K.K.) to give toner Bk-10.

Oil-less Fixing Black Toner

Example of Production Bk-11

Polyester resin F (L-type) (40 parts by weight), 60 parts by weight of polyester resin G (H-type), 2 parts by weight of polyethylene wax (800P; made by Mitsui Sekiyu Kagaku K.K.; melt viscosity 5,400 cps at 160° C.; softening point 140° C.), 2 parts by weight of polypropylene wax (TS-200; made by Sanyo Kasei Kogyo K.K.; melt viscosity 120 cps at 160° C.; softening point 145° C.; acid value 3.5 KOHmg/g), 8 parts by weight of acid carbon black (Mougl-L; made by Cabot K.K.; pH 2.5; average primary particle size 24 nm) and 2 parts by weight of a negative charge-control agent represented by the following chemical formula were sufficiently mixed by Henschel Mixer, and melt and kneaded by a twin screw-extruding kneader.

(A)

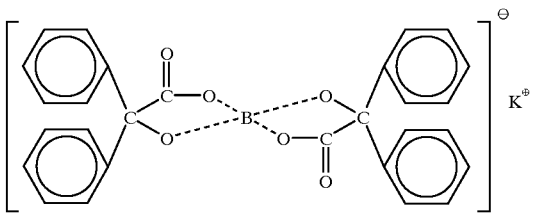

The kneaded materials were cooled off, coarsely pulverized by a hammer mill, and finely pulverized by a jet mill, and then classified. Thus, toner particles Bk-11 having a volume-average particle size of 7.5 μm were obtained.

To these toner particles were added 0.3% by weight of hydrophobic silica fine particles (TS500; made by Cabot K.K.) having a BET specific surface area of 225 $m^2$ and 0.8% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 μm to give toner.

Example of Production Bk-12

The same method and compositions as example of production for toner Y-5 were carried out so as to process toner particles Bk-11 except that the amount of fluidizing agent added prior to the thermal treatment was increased to 0.6 part by weight of hydrophobic silica (TS-500: made by Cabosil K.K.) and 1.2 parts by weight of hydrophobic silica (AEROSIL 90G (made by Nippon Aerosil K.K.) modified with hexamethylenedisilazane; BET specific surface area 65 $m^2/g$, degree of hydrophobicity 65%) and that the thermal treatment temperature was changed to 270° C. Thus, toner particles Bk-12 were obtained.

To these toner particles were added 0.3% by weight of hydrophobic silica fine particles (TS500; made by Cabot K.K.) having a BET specific surface area of 225 $m^2$ and 0.8% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 μm to give toner.

Examples of Production Bk-13 to Bk-15

The same method and compositions as example of production for toner Bk-12 were carried out except that the temperature conditions of the thermal treatment were respectively changed to 170° C., 220° C. and 320° C. Thus, toners (Bk-13 to 15) were obtained.

Examples of Production Bk-16 to Bk-19

The same method and compositions as examples of production Bk-12 to 15 were carried out except that the same conditions for thermal treatment as example of production for toner Y-10 to 13 were used except the treatment temperature. Thus toners Bk-16 to 19 were obtained.

Example of Production Bk-20

Styrene (60 parts by weight), 35 parts by weight of n-butyl methacrylate, 5 parts by weight of methacrylate, 0.5 part by weight of 2,2-azobis(2,4-dimethylvaleronitrile), 3 parts by weight of low molecular polypropylene (Viscol 660P; made by Sanyo Kasei Kogyo K.K.), 8 parts by weight of carbon black (MA#8; made by Mitsubishi Kagaku K.K.) and chrome complex (Aizen Spilon Black TRH; made by Hodogaya Kagaku K.K.) were sufficiently mixed by a sand stirrer to give a polymerization composition. This polymerization composition was allowed to react in an aqueous solution of arabic rubber having a concentration of 3% by weight for six hours at 60° C. while being stirred at 4,000 rpm by TK Auto Homo Mixer (made by Tokushukika Kogyo K.K.). Thus, spherical particles having an average particle size of 6.8 μm were obtained. The spherical particles were subjected to filtration/washing processes three times. The filtrated product was then dried by air under the conditions of 35° C. and 30% RH. Thus, toner particles Bk-20 was obtained.

To these toner particles were added 0.3% by weight of hydrophobic silica fine particles (TS500; made by Cabot K.K.) having a BET specific surface area of 225 $m^2$ and 0.8% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 μm to give toner.

Magnetic Black Toner

Example of Production Bk-21

Polyester resin F (L-type) (40 parts by weight), 60 parts by weight of polyester resin G (H-type), 2 parts by weight of polyethylene wax (800P; made by Mitsui Sekiyu Kagaku K.K.; melt viscosity 5,400 cps at 160° C.; softening point 140° C.), 2 parts by weight of polypropylene wax (TS-200; made by Sanyo Kasei Kogyo K.K.; melt viscosity 120 cps at 160° C.; softening point 145° C.; acid value 3.5 KOHmg/g), 50 parts by weight of magnetic particles (Magnetite; EPT-1,000: made by Toda Kogyo K.K.) and 2 parts by weight of chrome complex as a negative charge-control agent (Aizen Spilon Black TRH; made by Hodogaya Kagaku K.K.) were sufficiently mixed by Henschel Mixer, melt and kneaded by a twin screw-extruding kneader. Then, the kneaded materials were cooled off, coarsely pulverized by a hammer mill, and finely pulverized by a jet mill, and then classified. Thus, toner particles Bk-21 having a volume-average particle size of 7.0 μm was obtained.

To these toner particles were added 0.3% by weight of hydrophobic silica fine particles (TS500; made by Cabot K.K.) having a BET specific surface area of 225 $m^2$ and 0.8% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 μm to give toner.

Example of Production Bk-22

The same fluidizing process prior to the thermal treatment and thermal treatment conditions were adopted to process toner particles Bk-21 except that the treatment temperature was changed to 300° C. in the example of production for toner Bk-12. Thus, toner particles Bk-22 were obtained.

To these toner particles were added 0.3% by weight of hydrophobic silica fine particles (TS500; made by Cabot K.K.) having a BET specific surface area of 225 $m^2$ and 0.8% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 μm to give toner.

Examples of Production Bk-23 to Bk-25

The same method and compositions as example of production for toner Bk-22 were carried out except that the temperature conditions of the thermal treatment were respectively changed to 170° C., 250° C. and 360° C. Thus, toners Bk-23 to 25 were obtained.

Examples of Production Bk-26 to Bk-29

The same method and compositions as examples of production Bk-22 to 25 were carried out except that the same conditions for thermal treatment as example of production for toner Bk-16 to 19 were used except the treatment temperature. Thus toners Bk-26 to 29 were obtained.

Example of Production Bk-30

Styrene (60 parts by weight), 35 parts by weight of n-butyl methacrylate, 5 parts by weight of methacrylate, 0.5 part by weight of 2,2-azobis(2,4-dimethylvaleronitrile), 3 parts by weight of low molecular polypropylene (Viscol 660P; made by Sanyo Kasei Kogyo K.K.), 35 parts by weight of magnetic particles (ferrite particles; MFP-2; made by TDK K.K.) and chrome complex (Aizen Spilon Black TRH; made by Hodogaya Kagaku K.K.) were sufficiently mixed by a sand stirrer to give a polymerization composition. This polymerization composition was allowed to react for six hours at 60° C. in an aqueous solution of arabic rubber having a concentration of 3% by weight while being stirred at 5,000 rpm by TK Auto Homo Mixer (made by Tokushukika Kogyo K.K.). Thus, spherical particles having an average particle size of 6.8 μm were obtained. The spherical particles were subjected to filtration/washing processes three times, and the filtrated product was then dried by air under the conditions of 35° C. and 30% RH. Thus, toner particles Bk-30 was obtained.

To these toner particles were added 0.3% by weight of hydrophobic silica fine particles (TS500; made by Cabot K.K.) having a BET specific surface area of 225 $m^2$ and 0.8% by weight of strontium titanate fine particles (BET specific surface area 9 $m^2/g$). The mixture was mixed by Henschel Mixer at a peripheral speed of 40 m/sec for three minutes, and sieved by a sieve shaker having a screen mesh of 106 μm to give toner.

Binder-type Carrier

Examples of Production Carriers 1 to 3

Polyester resin (100 parts by weight) (made by Kao K.K.: NE-1110), 700 parts by weight of magnetic particles (Magnetite; EPT-1000: made by Toda Kogyo K.K.) and 2 parts by weight of carbon black (Mogul-L; made by Cabot K.K.) were sufficiently mixed by Henschel Mixer, melt and kneaded by a twin screw-extruding kneader which was set at 180° C. in the cylinder section and at 170° C. in the cylinder head section. Then, this kneaded matter was cooled off, coarsely pulverized by a hammer mill, and finely pulverized by a jet mill, and then classified. By adjusting the finely pulverizing and classifying conditions, carrier particles, carriers 1 to 3, respectively having volume-average particle size of 55 μm, 45 μm and 35 μm were obtained.

Examples of Production Carriers 4 to 6

To 100 parts by weight of the toner particles (carriers 1 to 3) were added 0.1 part by weight of hydrophobic silica (TS-500: made by Cabosil K.K., BET specific surface area 225 $m^2/g$) and 0.3 part by weight of hydrophobic silica (AEROSIL 90G (made by Nippon Aerosil K.K.) modified with hexamethylenedisilazane (BET specific surface area 65 $m^2/g$, degree of hydrophobicity; not less than 65%). The mixture was mixed by Henschel Mixer (peripheral speed 40 m/sec, for 60 seconds), and then subjected to a surface-modifying treatment by heat twice under the following conditions by using an instantaneous heating device having a structure as shown in FIG. 1. Thus, carrier particles (carriers 4 to 6) were obtained.

(Thermal treatment condition 3)

Developer supplying section; Table feeder+vibration feeder

Dispersing nozzle; Four (Symmetric layout with 90 degrees respectively to all circumference)

Ejecting angle; 30 degrees

Amount of hot air; 800 L/min

Amount of dispersing air; 55 L/min

Amount of suction air; −1200 L/min

Dispersion density; 200 $g/m^3$

Processing temperature; 350° C.

Residence time; 1.0 second

Temperature of cooling air; 15° C.

Temperature of cooling water; 10° C.

Examples of Production Carriers 7 to 9

The same methods and compositions as the example of production for carrier 6 were adopted except that the thermal temperatures in the thermal treating process were changed to 150, 300 and 450° C. Thus, carrier particles (carriers 7 to 9) were obtained.

Examples of Production Carriers 10 to 13

The same methods and compositions as the examples of production for carriers 6 to 9 were adopted to carry out a surface-modifying process once except that the treating temperature in the thermal treatment was changed to 150, 300, 350 and 450° C. respectively. Thus, carrier particles 10 to 13 were obtained.

(Thermal treatment condition 4)

Developer supplying section; Table feeder

Dispersing nozzle; Two (Symmetric layout to all circumference)

Ejecting angle; 45 degrees

Amount of hot air; 620 L/min

Amount of dispersing air; 68 L/min

Amount of suction air; −900 L/min

Dispersion density; 150 g/m$^3$

Processing temperature; 150, 300, 350, 450° C.

Residence time; 0.5 second

Temperature of cooling air; 30° C.

Temperature of cooling water; 20° C.

With respect to the toners and carriers obtained in the above, the following factors are listed in Tables 2 through 6: Thermal treatment conditions, treatment temperatures, weight-average particle size of toner ($d_{50}$) ($\mu$m), content of particles having not less than two times the weight-average particle size (>2$d_{50}$(wt %)), content of particles having not more than ⅓ the weight-average particle size (<⅓$d_{50}$ (pop %)), average degree of roundness, standard deviation of the degree of roundness (SD), toner-surface shape characteristics ($D/d_{50}$), and BET specific surface area (S).

The average particle size and its distribution were measured by Coulter Multisizer II (made by Coulter Counter K.K.) with an aperture tube diameter of 50 $\mu$m. The particle sizes of the carriers were measured by Coulter Multisizer II (made by Coulter Counter K.K.) with an aperture tube diameter of 150 $\mu$m.

The average degree of roundness and the SD value were measured by a flow-type particle image analyzer (EPIA-2000; made by Toa Iyoudenshi K.K.) in an aqueous dispersion system.

The BET specific surface area (S) required for calculating $D/d_{50}$ was measured by Flow Sorb 2,300 (made by Shimazu Seisakusho K.K.).

The true density (ρ) were measured by an air-comparative specific gravity meter (made by Beckman K.K.).

TABLE 2

| | | | Developer Preparation Conditions and Physical Properties SD: standard deviation | | | | | | | |
|---|---|---|---|---|---|---|---|---|---|---|
| No. | Example/ Comparative Example | Heat Treat Conditions | Treating Temperature | $d_{50}$ (;$\mu$m) | <2$d_{50}$ (wt %) | <1/3$d_{50}$ (number %) | Mean roundness | Roundness SD | Specific surface area | $D/d_{50}$ |
| Y-1 | Comparative Example | Nil | Nil | 7.1 | 0.1 | 3.2 | 0.943 | 0.039 | 2.11 | 0.36 |
| Y-2 | Example | 1 | 250° C. | 7.1 | 0.1 | 2.8 | 0.981 | 0.026 | 1.41 | 0.54 |
| Y-3 | Comparative Example | 1 | 150° C. | 7.1 | 0.1 | 3.1 | 0.945 | 0.037 | 1.98 | 0.39 |
| Y-4 | Example | 1 | 200° C. | 7.1 | 0.1 | 2.9 | 0.961 | 0.034 | 1.47 | 0.52 |
| Y-5 | Example | 1 | 300° C. | 7.2 | 0.1 | 2.7 | 0.990 | 0.018 | 1.32 | 0.57 |
| Y-6 | Example | 1 | 250° C. | 7.2 | 0.1 | 2.5 | 0.984 | 0.024 | 1.43 | 0.53 |
| Y-7 | Example | 1 | 250° C. | 7.2 | 0.1 | 2.6 | 0.980 | 0.028 | 1.44 | 0.53 |
| Y-8 | Example | 1 | 250° C. | 7.2 | 0.1 | 2.7 | 0.978 | 0.029 | 1.47 | 0.52 |
| Y-9 | Comparative Example | (Emulsion granulation) | Nil | 7.2 | 0.3 | 4.1 | 0.980 | 0.034 | 2.15 | 0.35 |
| Y-10 | Comparative Example | 2 | 250° C. | 7.8 | 0.7 | 2.8 | 0.961 | 0.044 | 1.37 | 0.51 |
| Y-11 | Comparative Example | 2 | 150° C. | 7.1 | 0.2 | 3.2 | 0.952 | 0.038 | 2.22 | 0.35 |
| Y-12 | Comparative Example | 2 | 200° C. | 7.4 | 0.4 | 3.1 | 0.957 | 0.037 | 1.65 | 0.45 |
| Y-13 | Comparative Example | 2 | 300° C. | 8.4 | 1.6 | 2.8 | 0.972 | 0.046 | 1.21 | 0.54 |

TABLE 3

| No. | Example/ Comparative Example | Heat Treat Conditions | Treating Temperature | $d_{50}$ (μm) | $<2d_{50}$ (wt %) | $<1/3d_{50}$ (number %) | Mean roundness | Roundness SD | Specific surface area | $D/d_{50}$ |
|---|---|---|---|---|---|---|---|---|---|---|
| | | Developer Preparation Conditions and Physical Properties SD: standard deviation | | | | | | | | |
| c-1 | Comparative Example | Nil | Nil | 7.1 | 0.1 | 3.2 | 0.943 | 0.039 | 2.01 | 0.36 |
| c-2 | Example | 1 | 250° C. | 7.0 | 0.1 | 2.8 | 0.981 | 0.026 | 1.42 | 0.54 |
| c-3 | Comparative Example | 1 | 150° C. | 7.1 | 0.1 | 3.1 | 0.945 | 0.037 | 1.98 | 0.39 |
| c-4 | Example | 1 | 200° C. | 7.1 | 0.1 | 2.9 | 0.961 | 0.034 | 1.46 | 0.52 |
| c-5 | Example | 1 | 300° C. | 7.3 | 0.1 | 2.5 | 0.991 | 0.018 | 1.31 | 0.57 |
| c-6 | Example | 1 | 250° C. | 7.2 | 0.1 | 2.4 | 0.985 | 0.023 | 1.43 | 0.53 |
| c-7 | Example | 1 | 250° C. | 7.1 | 0.1 | 2.6 | 0.981 | 0.027 | 1.45 | 0.53 |
| c-8 | Example | 1 | 250° C. | 7.2 | 0.1 | 2.7 | 0.978 | 0.029 | 1.47 | 0.52 |
| c-9 | Comparative Example | (Emulsion granulation) | Nil | 7.2 | 0.3 | 4.1 | 0.980 | 0.034 | 2.16 | 0.35 |
| c-10 | Comparative Example | 2 | 250° C. | 7.8 | 0.7 | 2.8 | 0.960 | 0.044 | 1.37 | 0.51 |
| c-11 | Comparative Example | 2 | 150° C. | 7.1 | 0.2 | 3.2 | 0.952 | 0.038 | 2.21 | 0.35 |
| c-12 | Comparative Example | 2 | 200° C. | 7.4 | 0.4 | 3.1 | 0.957 | 0.037 | 1.65 | 0.45 |
| c-13 | Comparative Example | 2 | 300° C. | 8.4 | 1.6 | 2.8 | 0.972 | 0.046 | 1.20 | 0.54 |

TABLE 4

| No. | Example/ Comparative Example | Heat Treat Conditions | Treating Temperature | $d_{50}$ (μm) | $<2d_{50}$ (wt %) | $<1/3d_{50}$ (number %) | Mean roundness | Roundness SD | Specific surface area | $D/d_{50}$ |
|---|---|---|---|---|---|---|---|---|---|---|
| | | Developer Preparation Conditions and Physical Properties SD: standard deviation | | | | | | | | |
| M-1 | Comparative Example | Nil | Nil | 7.1 | 0.1 | 3.2 | 0.943 | 0.039 | 2.11 | 0.36 |
| M-2 | Example | 1 | 250° C. | 7.0 | 0.1 | 2.8 | 0.981 | 0.026 | 1.42 | 0.54 |
| M-3 | Comparative Example | 1 | 150° C. | 7.1 | 0.1 | 3.1 | 0.945 | 0.037 | 1.97 | 0.39 |
| M-4 | Example | 1 | 200° C. | 7.1 | 0.1 | 2.9 | 0.961 | 0.034 | 1.46 | 0.52 |
| M-5 | Example | 1 | 300° C. | 7.1 | 0.1 | 2.7 | 0.990 | 0.018 | 1.32 | 0.57 |
| M-6 | Example | 1 | 250° C. | 7.1 | 0.1 | 2.5 | 0.984 | 0.024 | 1.44 | 0.53 |
| M-7 | Example | 1 | 250° C. | 7.2 | 0.1 | 2.6 | 0.980 | 0.028 | 1.45 | 0.53 |
| M-8 | Example | 1 | 250° C. | 7.2 | 0.1 | 2.7 | 0.978 | 0.029 | 1.46 | 0.52 |
| M-9 | Comparative Example | (Emulsion granulation) | Nil | 7.2 | 0.3 | 4.1 | 0.980 | 0.034 | 2.15 | 0.35 |
| M-10 | Comparative Example | 2 | 250° C. | 7.8 | 0.7 | 2.8 | 0.962 | 0.045 | 1.37 | 0.51 |
| M-11 | Comparative Example | 2 | 150° C. | 7.1 | 0.2 | 3.2 | 0.952 | 0.038 | 2.22 | 0.35 |
| M-12 | Comparative Example | 2 | 200° C. | 7.4 | 0.4 | 3.1 | 0.957 | 0.037 | 1.66 | 0.45 |
| M-13 | Comparative Example | 2 | 300° C. | 8.4 | 1.6 | 2.8 | 0.972 | 0.046 | 1.21 | 0.54 |

TABLE 5

Developer Preparation Conditions and Physical Properties
SD: standard deviation

| No. | Ex./ Comp. Ex. | Heat Treat Conditions | Treating Temperature | $d_{50}$ (:μm) | <$2d_{50}$ (wt %) | <$1/3d_{50}$ (number %) | Mean roundness | Roundness SD | Specific surface area | $D/d_{50}$ |
|---|---|---|---|---|---|---|---|---|---|---|
| Bk-1 | Comp. Ex. | Nil | Nil | 7.1 | 0.1 | 3.3 | 0.942 | 0.040 | 2.10 | 0.37 |
| Bk-2 | Example | 1 | 250° C. | 7.0 | 0.1 | 3.0 | 0.983 | 0.026 | 1.39 | 0.54 |
| Bk-3 | Comp. Ex. | 1 | 150° C. | 7.1 | 0.1 | 3.3 | 0.947 | 0.036 | 1.97 | 0.39 |
| Bk-4 | Ex. | 1 | 200° C. | 7.0 | 0.1 | 2.8 | 0.963 | 0.036 | 1.45 | 0.54 |
| Bk-5 | Ex. | 1 | 300° C. | 7.1 | 0.1 | 2.6 | 0.991 | 0.017 | 1.32 | 0.58 |
| Bk-6 | Comp. Ex. | 2 | 250° C. | 7.9 | 0.9 | 2.6 | 0.963 | 0.046 | 1.39 | 0.50 |
| Bk-7 | Comp. Ex. | 2 | 150° C. | 7.2 | 0.2 | 2.8 | 0.954 | 0.038 | 2.21 | 0.34 |
| Bk-8 | Comp. Ex. | 2 | 200° C. | 7.5 | 0.4 | 2.8 | 0.955 | 0.039 | 1.65 | 0.44 |
| Bk-9 | Comp. Ex. | 2 | 300° C. | 8.6 | 2.0 | 2.5 | 0.970 | 0.048 | 1.19 | 0.53 |
| Bk-10 | Comp. Ex. | Nil | Nil | 7.2 | 0.4 | 4.5 | 0.981 | 0.037 | 2.16 | 0.35 |
| Bk-11 | Comp. Ex. | Nil | Nil | 7.1 | 0.1 | 4.6 | 0.944 | 0.041 | 2.09 | 0.37 |
| Bk-12 | Ex. | 1 | 270° C. | 7.2 | 0.1 | 4.1 | 0.980 | 0.030 | 1.42 | 0.53 |
| Bk-13 | Comp. Ex. | 1 | 170° C. | 7.1 | 0.1 | 4.4 | 0.945 | 0.041 | 1.95 | 0.39 |
| Bk-14 | Ex. | 1 | 220° C. | 7.1 | 0.1 | 4.3 | 0.960 | 0.034 | 1.44 | 0.53 |
| Bk-15 | Ex. | 1 | 320° C. | 7.2 | 0.1 | 3.7 | 0.986 | 0.027 | 1.35 | 0.56 |
| Bk-16 | Comp. Ex. | 2 | 270° C. | 8.1 | 1.1 | 4.0 | 0.970 | 0.042 | 1.38 | 0.49 |
| Bk-17 | Comp. Ex. | 2 | 170° C. | 7.2 | 0.4 | 4.1 | 0.949 | 0.042 | 2.24 | 0.34 |
| Bk-18 | Comp. Ex. | 2 | 220° C. | 7.4 | 0.9 | 3.8 | 0.953 | 0.045 | 1.61 | 0.46 |
| Bk-19 | Comp. Ex. | 2 | 320° C. | 8.8 | 2.4 | 3.6 | 0.968 | 0.049 | 1.17 | 0.53 |
| Bk-20 | Comp. Ex. | Nil | Nil | 6.8 | 0.4 | 4.4 | 0.988 | 0.036 | 2.24 | 0.36 |
| Bk-21 | Comp. Ex. | Nil | Nil | 7.0 | 0.1 | 4.6 | 0.934 | 0.045 | 3.11 | 0.15 |
| Bk-22 | Ex. | 1 | 300° C. | 7.1 | 0.1 | 3.8 | 0.976 | 0.035 | 1.41 | 0.32 |
| Bk-23 | Comp. Ex. | 1 | 170° C. | 7.1 | 0.1 | 4.4 | 0.938 | 0.042 | 2.37 | 0.19 |
| Bk-24 | Ex. | 1 | 250° C. | 7.2 | 0.1 | 3.8 | 0.955 | 0.039 | 1.68 | 0.26 |
| Bk-25 | Ex. | 1 | 350° C. | 7.3 | 0.1 | 2.8 | 0.986 | 0.029 | 1.16 | 0.37 |
| Bk-26 | Comp. Ex. | 2 | 300° C. | 7.8 | 1.7 | 3.6 | 0.939 | 0.049 | 1.50 | 0.27 |
| Bk-27 | Comp. Ex. | 2 | 170° C. | 7.3 | 0.2 | 4.4 | 0.936 | 0.050 | 2.65 | 0.16 |
| Bk-28 | Comp. Ex. | 2 | 250° C. | 7.5 | 0.7 | 3.7 | 0.950 | 0.047 | 1.75 | 0.24 |
| Bk-29 | Comp. Ex. | 2 | 350° C. | 9.3 | 4.1 | 2.6 | 0.927 | 0.055 | 1.22 | 0.28 |
| Bk-30 | Comp. Ex. | Nil | Nil | 6.8 | 0.5 | 4.2 | 0.986 | 0.038 | 3.04 | 0.17 |

TABLE 6

Developer Preparation Conditions and Physical Properties
SD: standard deviation

| No. | Example/ Comparative Example | Heat Treat Conditions | Treating Temperature | $d_{50}$ (:μm) | <$2d_{50}$ (wt %) | <$1/3d_{50}$ (number %) | Mean roundness | Roundness SD | Specific surface area | $D/d_{50}$ |
|---|---|---|---|---|---|---|---|---|---|---|
| Carrier 1 | Comparative Example | Nil | Nil | 55.2 | 0.0 | 0.1 | 0.895 | 0.070 | 13.2 | 0.024 |
| Carrier 2 | Comparative Example | Nil | Nil | 45.3 | 0.0 | 0.3 | 0.897 | 0.068 | 17.1 | 0.023 |
| Carrier 3 | Comparative Example | Nil | Nil | 35.0 | 0.0 | 1.0 | 0.897 | 0.068 | 22.5 | 0.022 |
| Carrier 4 | Example | 3 | 350° C. | 55.4 | 0.0 | 0.0 | 0.943 | 0.051 | 7.2 | 0.044 |
| Carrier 5 | Example | 3 | 350° C. | 45.6 | 0.0 | 0.0 | 0.947 | 0.053 | 8.8 | 0.044 |
| Carrier 6 | Example | 3 | 350° C. | 35.4 | 0.0 | 0.1 | 0.953 | 0.055 | 10.6 | 0.047 |
| Carrier 7 | Comparative Example | 3 | 150° C. | 35.1 | 0.0 | 0.5 | 0.914 | 0.061 | 17.7 | 0.028 |
| Carrier 8 | Example | 3 | 300° C. | 35.2 | 0.0 | 0.3 | 0.938 | 0.051 | 11.9 | 0.042 |
| Carrier 9 | Example | 3 | 450° C. | 35.5 | 0.0 | 0.0 | 0.971 | 0.043 | 9.7 | 0.051 |
| Carrier 10 | Comparative Example | 4 | 150° C. | 35.1 | 0.0 | 0.8 | 0.904 | 0.060 | 18.2 | 0.028 |
| Carrier 11 | Comparative Example | 4 | 300° C. | 35.1 | 0.2 | 0.7 | 0.921 | 0.057 | 14.5 | 0.0035 |
| Carrier 12 | Comparative Example | 4 | 350° C. | 35.3 | 0.8 | 0.5 | 0.928 | 0.055 | 12.9 | 0.0039 |
| Carrier 13 | Comparative Example | 4 | 450° C. | 35.4 | 1.2 | 0.3 | 0.966 | 0.051 | 11.0 | 0.045 |

(Evaluation as mono-component developing agent)

The toners for full-color development of the present invention, obtained as described above, are effectively used in a full-color image-forming method in which: a toner image formed on an image-supporting member is pressed and transferred onto an intermediate transfer member for each color in a superimposed manner, and the toner image transferred on the intermediate transfer member is pressed and transferred onto a recording member. In other words, in the full-color image-forming method using the above toner of the present invention, it is possible to prevent image losses of toner images and toner-scattering in primary and secondary copying processes, to prevent fogs in full-color copied images, and also to provide superior transferring properties and following properties. No toner selection (with respect to shape, size, etc.) occurs on the toner-supporting member, thereby making it possible to provide stable images for a long time. Further, since the toner of the present invention has a superior toner shape and surface smoothness, it has high durability against stress so that it is possible to reduce the occurrence of fine particles due to buried post-processing agents and cracking of toner. Thus, even in the case of the application of resins having low softening points capable of providing low-temperature-fixing properties and light-transmitting properties for OHP, which are the properties recently demanded, the toner of the present invention fully satisfies the required performance (quality).

It becomes possible to achieve a wider scope of operability with high system speeds and long life in image-forming apparatuses such as printers.

An explanation will be given of a full-color image-forming method using the above-mentioned full-color developing toner by exemplifying a known full-color image-forming apparatus shown in FIG. 3. In the full-color image-forming apparatus, a photosensitive member is used as the image-supporting member, an endless intermediate transfer belt is used as the intermediate transfer member, and a sheet of recording paper is used as the recording member.

Figure 3:
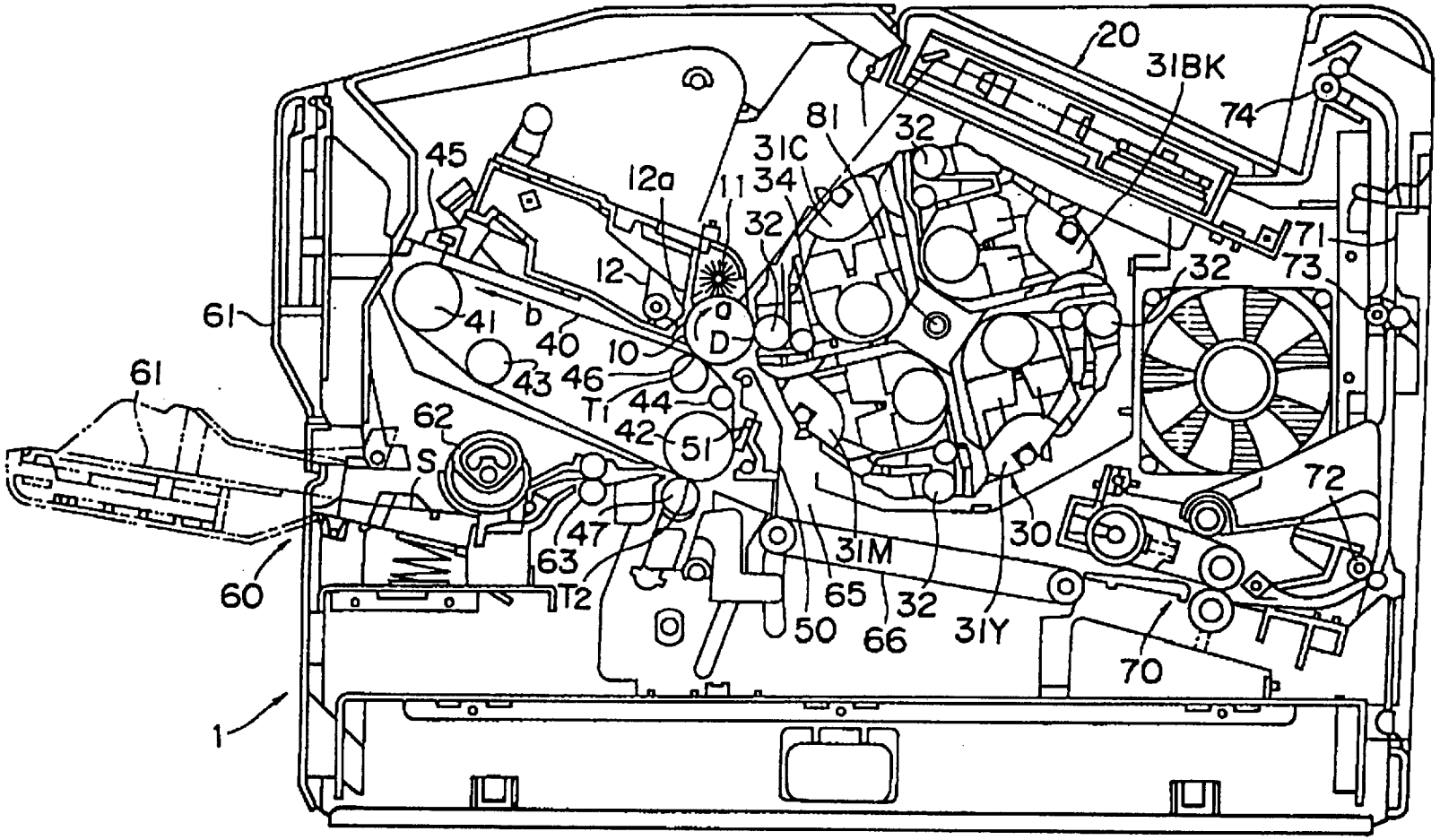
FIG. 3 is a schematic constitutional view of mono-component full-color image-forming apparatus.

In FIG. 3, the full-color image-forming apparatus is schematically constituted by a photoconductive drum 10 that is rotationally driven in the arrow a direction, a laser scanning optical system 20, a full-color developing device 30, an endless intermediate transfer belt 40 that is rotationally driven in the arrow b direction, and a paper-feed section 60. On the periphery of the photoconductive drum 10 are further installed a charging blush 11 for charging the surface of the photoconductive drum 10 to a predetermined electric potential, and a cleaner 12 having a cleaner blade 12*a* for removing toner remaining on the photoconductive drum 10. In Examples, the cleaner system is changed to a brush-cleaning system in order to ensure reliability of cleaning properties with respect to spherical toner, and experiments were carried out.

The laser scanning optical system 20 is a known system equipped with a laser diode, a polygon mirror and an f□ optical element, and its control section receives print data classified into C(cyan), M(magenta), Y(yellow) and Bk(black) from a host computer. The laser scanning optical system 20 outputs print data for the respective colors successively as laser beams, thereby scanning and exposing the photoconductive drum 10. Thus, electrostatic latent images for the respective colors are successively formed on the photoconductive drum 10.

The full-color developing device 30 is integrally provided with four developing devices 31Y, 31M, 31C and 31Bk separated for housing the non-magnetic toners Y, M, C and Bk respectively, and is allowed to rotate clockwise on a supporting shaft 81 as a supporting point. Each developing device has a developing sleeve 32 and a toner regulating blade 34. Toner, which is fed by the rotation of the developing sleeve 32, is charged when it is allowed to pass through a contact section (gap) between the blade 34 and the developing sleeve 32.

With respect to the installation positions of the developing devices housing the respective toners, or yellow toner, magenta toner, cyan toner and black toner, these positions are dependent on purposes of copying processes, that is, whether the purpose of the full-color image-forming apparatus is to copy line and graphic images such as characters or to copy images having gradations in respective colors such as photographic images. For example, in the case of copying of line and graphic images such as characters, a kind of toner having no gloss properties (luster) is used as black toner, and in this case, when the black toner layer is formed as the uppermost layer on a full-color copied image, inconsistency appears thereon; therefore, the black toner is preferably attached to the developing device so as not to form the black toner layer as the uppermost layer on a full-color copied image. It is most preferable to attach the black toner so that the black toner layer is formed as the lowermost layer on copied images, that is, so that, in the primary transfer process, the black toner layer is formed as the uppermost layer on the intermediate transfer member. Therefore, the yellow toner, magenta toner, and cyan toner (color toners) are attached to the developing device arbitrarily so that in the primary transfer process, each of the layers is formed as any of the first through third layers in the order of formation thereof.

The intermediate transfer belt 40 is mounted over support rollers 41 and 42 and tension rollers 43 and 44 in an endless from, and is rotationally driven in the arrow b direction in synchronism with the photoconductive drum 10. A protrusion (not shown) is placed on the side of the intermediate transfer belt 40, and a micro-switch 45 detects the protrusion so that the image-forming processes, such as exposure, developing and transferring, are controlled. The intermediate transfer belt 40 is pressed by a primary transfer roller 46 that is freely rotatable so as to come into contact with the photoconductive drum 10. This contact section forms a primary transfer section T1. Moreover, the intermediate transfer belt 40 comes into contact with a secondary transfer roller 47 that is freely rotatable at its portion supported by the support roller 42. This contact portion forms a secondary transfer section T2.

A cleaner 50 is installed in a space between the developing device 30 and the intermediate transfer belt 40. The cleaner 50 has a blade 51 for removing residual toner from the intermediate transfer belt 40. This blade 51 and the secondary transfer roller 47 are detachably attached to the intermediate transfer belt 40.

The paper-feed section 60 is constituted by a paper-feed tray 61 that is freely opened on the front side of the image-forming apparatus main body 1, a paper-feed roller 62 and a timing roller 63. Recording sheets S are stacked on the paper-feed tray 61, and fed to the right in the FIG. one sheet by one sheet in accordance with the rotation of the paper-feed roller 62, and then transported to the secondary transfer section in synchronism with an image formed on the intermediate transfer belt 40 by the timing roller 63. A horizontal transport path 65 for recording sheets is constituted by an air-suction belt 66, etc. with the paper-feed section being included therein, and a vertical transport path 71 having transport rollers 72, 73 and 74 extends from the fixing device 70. The recording sheets S are discharged onto the upper surface of the image-forming apparatus main body 1 from this vertical transport path 71.

Next, an explanation will be given of the printing process of the full-color image-forming apparatus.

When a printing process is started, the photoconductive drum 10 and the intermediate transfer belt 40 are rotationally driven at the same peripheral velocity, and the photoconductive drum 10 is charged to a predetermined electric potential by the charging brush 11.

Successively, exposure for a cyan image is carried out by the laser scanning optical system 20 so that an electrostatic latent image of the cyan image is formed on the photoconductive drum 10. This electrostatic latent image is directly developed by the developing device 31C, and the toner image is transferred onto the intermediate transfer belt 40 at the primary transfer section. Immediately after the completion of the primary transferring process, switching is made to the developing device 31M in the developing section D, and successively, exposure, developing and primary transferring processes are carried out for a magenta image. Switching is further made to the developing device 31Y, and exposure, developing and primary transferring processes are carried out for a yellow image. Switching is further made to the developing device 30 Bk, and exposure, developing and primary transferring processes are carried out for a black image. Thus, the toner images are superimposed one by one on the intermediate transfer belt 40 for the respective primary transferring processes 1.

When the final primary transferring process is completed, a recording sheet S is sent to the secondary transfer section, and a full-color toner image, formed on the intermediate transfer belt 40, is transferred onto the recording sheet S. Upon completion of this secondary transferring process, the recording sheet S is transported to a belt-type contact-heating fixing device 70 where the full-color toner image is fixed onto the recording sheet S; then, the recording sheet S is discharged onto the upper surface of the printer main body.

The full-color toner of the present invention may be applied to a mono-component developing system in which toner is electrically charged when passing through between a toner-regulating blade and a developing sleeve, as described above, or a two-component developing system in which toner is electrically charged through friction with carrier. In general, as the stress applied on toner particles in the mono-component developing system is higher than that in the two-component developing system, the toner used in the mono-component developing system is required to have stress-resistant properties compared with the toner used in the two-component developing system. The toner of the present invention may be adequately applied to both a contact-developing method and a non-contact-developing method.

By using a full-color printer (Color Page Pro TMPS: made by Minolta K.K.) having a structure shown in FIG. 3 with the amount of oil application being increased so as to prevent offset, various evaluation tests were carried out in combination with color toners shown in Table 7. The evaluation was made under high-temperature, high-humidity environments (HH environments) (30° C., 85% RH) and under low-temperature, low-humidity environments (LL environments) (10° C., 15% RH) on fogs, image losses, transferring properties, following properties and toner particle diameter on the sleeve. The following Table 7 shows the results of initial evaluation.

Moreover, evaluation was also made on images obtained after copying processes of 3,000(3K) sheets under normal environments (LL environments) (10° C., 15% RH), and the results are shown in Table 8.

Fogs

The above-mentioned full-color developing toners were loaded in a full-color printer (Color Page Pro TMPS: made by Minolta K.K.). After 10 copies of a character pattern image of B/W ratio of 30% were continuously made in 4-color superposing mode, a copied image was visually observed and checked for fog, and ranked as follows. The four kinds of toners were loaded into four developing devices respectively so as to form layers Y, M, C and Bk in the order from the bottom on the intermediate transfer belt.

○: Virtually no fog was observed;

Δ: Fogs slightly observed; however, no problem arose in practical use;

X: Fogs observed all over the surface; problems arose in practical use.

Image-Losses

The above-mentioned full-color developing toners were loaded in a full-color printer (Color Page Pro TMPS: made by Minolta K.K.). After 10 copies of a full-color image (general pattern) were made in 4-color superposing mode, a full-color copied image was evaluated on image-losses and ranked as follows. The four kinds of toners were loaded into four developing devices respectively so as to form layers Y, M, C and Bk in the order from the bottom on the intermediate transfer belt.

○: No image-loss was observed;

Δ: Image-losses were slightly observed; however, no problem arose in practical use;

X: Many image-losses were observed on copied images; problems arose in practical use.

Scattering

The above-mentioned full-color developing toners were loaded in a full-color printer (Color Page Pro TMPS: made by Minolta K.K.). After 10 copies of a full-color image (general pattern) were made in 4-color superposing mode, a full-color copied image was evaluated on scattering and ranked as follows. The four kinds of toners were loaded into four developing devices respectively so as to form layers Y, M, C and Bk in the order from the bottom on the intermediate transfer belt.

○: Virtually no scattering was observed around copied image of lines;

Δ: Scattering was slightly observed around copied image of lines; however, no problem arose in practical use; p0 X: Much scattering was observed around copied images of lines and recognized as blurring; problems arose in practical use.

Transferring properties

The above-mentioned full-color developing toners were loaded into a full-color printer (Color Page Pro TMPS; made by Minolta K.K). Six kinds (6 colors) of solid patterns, yellow, magenta, cyan, red, green and blue (hereinafter, referred to as Y, M, C, R, G and B), were copied. After 10-th copying process was finished, a ratio of an amount of toner adhesion on paper to an amount of toner adhesion on the photosensitive drum was evaluated, and ranked as follows:

○: With respect to the six patterns, all the ratios were not less than 80%;

Δ: With respect to the six patterns, among the ratios, the minimum value was in a range between not less than 70% and less than 80%;

X: With respect to the six patterns, among the ratios, the minimum value was less than 70%.

Following properties

After 10 sheets of copies (B/W 30%) were made, an image of B/W 100% was printed out, and the copied image was evaluated on its irregularity in density and ranked as follows:

○: No irregularity in density;

Δ: Density irregularity slightly occurred; however, no problem arose in practical use;

X: Density irregularity occurred.

With respect to toner particle size on the sleeve, evaluation was made on the difference in toner particle sizes (average particle size and number % of fine particle components) of toner left in the developing devices.

○: Difference is less than 10%.

Δ: Difference is in a range of 10% to 20%.

X: Particle-size selection not less than 20% occurred.

By using a full-color printer (Color Page Pro TMPS: made by Minolta K.K.), evaluation was made in the monochrome single-color mode by the use of oil-less fixing toners shown in Tables 9 and 10 as toners. The evaluation was carried out in the same manner as the above-mentioned full-color evaluation. FIG. 9 shows the results of initial evaluation under HH and LL environments. FIG. 10 shows the results of evaluation after 3,000 copies were made under NN environments.

TABLE 7

Full Color

| | Toner | | | | Evaluation (initial HH/LL) | | | | | | |
|---|---|---|---|---|---|---|---|---|---|---|---|
| | Y Toner | M Toner | C Toner | Bk Toner | Fog | Lines | Image Losses | Scattering | Transfer Properties | Following Properties | Toner particle size On-sleeve |
| Example 1 | Y-2 | M-2 | C-2 | Bk-2 | ○/○ | ○/○ | ○/○ | ○/○ | ○/○ | ○/○ | ○/○ |
| Example 2 | Y-4 | M-4 | C-4 | Bk-4 | ○/○ | ○/○ | ○/○ | ○/○ | ○/○ | ○/○ | ○/○ |
| Example 3 | Y-5 | M-5 | C-5 | Bk-5 | ○/○ | ○/○ | ○/○ | ○/○ | ○/○ | ○/○ | ○/○ |
| Example 4 | Y-6 | M-6 | C-6 | Bk-4 | ○/○ | ○/○ | ○/○ | ○/○ | ○/○ | ○/○ | ○/○ |
| Example 5 | Y-7 | M-7 | C-7 | Bk-4 | ○/○ | ○/○ | ○/○ | ○/○ | ○/○ | ○/○ | ○/○ |
| Example 6 | Y-8 | M-8 | C-8 | Bk-4 | ○/○ | ○/○ | ○/○ | ○/○ | ○/○ | ○/○ | ○/○ |
| Comparative Example 1 | Y-1 | M-1 | C-1 | Bk-1 | ○/○ | ○/○ | X/Δ | ○/○ | X/Δ | ○/○ | Δ/X |
| Comparative Example 2 | Y-3 | M-3 | C-3 | Bk-3 | ○/○ | ○/○ | X/Δ | ○/○ | X/Δ | ○/○ | Δ/X |
| Comparative Example 3 | Y-9 | M-9 | C-9 | Bk-10 | ○/○ | ○/○ | ○/○ | ○/○ | ○/○ | ○/○ | ○/Δ |
| Comparative Example 4 | Y-10 | M-10 | C-10 | Bk-6 | — | X/X | — | — | — | — | — |
| Comparative Example 5 | Y-11 | M-11 | C-11 | Bk-7 | X/Δ | ○/○ | X/Δ | ○/○ | X/Δ | X/Δ | X/X |
| Comparative Example 6 | Y-12 | M-12 | C-12 | Bk-8 | Δ/Δ | X/Δ | Δ/Δ | ○/○ | X/Δ | X/Δ | Δ/X |
| Comparative Example 7 | Y-13 | M-13 | C-13 | Bk-9 | — | X/X | — | — | — | — | — |

In the table, "—" indicates that in the course of a number of copies, copying was discontinued due to image noise and the apparatus conditions which prevented the continuation of printing.

TABLE 8

| | Toner | | | | After 3K endurance in NN environment | | | | | | |
|---|---|---|---|---|---|---|---|---|---|---|---|
| | Y Toner | M Toner | C Toner | Bk Toner | Fog | Lines | Image Losses | Scattering | Transfer Properties | Following Properties | Toner particle size On-sleeve |
| Example 1 | Y-2 | M-2 | C-2 | Bk-2 | ○ | ○ | ○ | ○ | ○ | ○ | ○ |
| Example 2 | Y-4 | M-4 | C-4 | Bk-4 | ○ | ○ | ○ | ○ | ○ | ○ | ○ |
| Example 3 | Y-5 | M-5 | C-5 | Bk-5 | ○ | ○ | ○ | ○ | ○ | ○ | ○ |
| Example 4 | Y-6 | M-6 | C-6 | Bk-4 | ○ | ○ | ○ | ○ | ○ | ○ | ○ |
| Example 5 | Y-7 | M-7 | C-7 | Bk-4 | ○ | ○ | ○ | ○ | ○ | ○ | ○ |
| Example 6 | Y-8 | M-8 | C-8 | Bk-4 | ○ | ○ | ○ | ○ | ○ | ○ | ○ |
| Comparative Example 1 | Y-1 | M-1 | C-1 | Bk-1 | — | X | — | — | — | X | — |
| Comparative Example 2 | Y-3 | M-3 | C-3 | Bk-3 | — | X | — | — | — | X | — |
| Comparative Example 3 | Y-9 | M-9 | C-9 | Bk-10 | Δ | X | Δ | ○ | Δ | X | — |
| Comparative Example 4 | Y-10 | M-10 | C-10 | Bk-6 | — | — | — | — | — | — | — |
| Comparative Example 5 | Y-11 | M-11 | C-11 | Bk-7 | — | X | — | — | — | X | — |
| Comparative Example 6 | Y-12 | M-12 | C-12 | Bk-8 | — | X | — | — | — | X | — |
| Comparative Example 7 | Y-13 | M-13 | C-13 | Bk-9 | — | — | — | — | — | — | — |

In the table, "—" indicates that in the course of a number of copies, copying was discontinued due to image noise and the apparatus conditions which prevented the continuation of printing.

TABLE 9

| | Oil-less Fixing Toner | | | | | | |
|---|---|---|---|---|---|---|---|
| | Evaluation (initial HH/LL) | | | | | | |
| | Bk Toner | Fog | Lines | Image Losses | Transfer Properties | Following Properties | Toner particle size On-sleeve |
| Example 1 | Bk-12 | ○/○ | ○/○ | ○/○ | ○/○ | ○/○ | ○/○ |
| Example 2 | Bk-14 | ○/○ | ○/○ | ○/○ | ○/○ | ○/○ | ○/○ |
| Example 3 | Bk-15 | ○/○ | ○/○ | ○/○ | ○/○ | ○/○ | ○/○ |
| Comparative Example 1 | Bk-11 | ○/○ | ○/○ | Δ/○ | Δ/○ | ○/○ | X/X |
| Comparative Example 2 | Bk-13 | ○/○ | ○/○ | ○/○ | ○/○ | ○/○ | X/X |
| Comparative Example 3 | Bk-16 | ○/○ | X/X | ○/○ | ○/○ | X/X | ○/Δ |
| Comparative Example 4 | Bk-17 | ○/○ | ○/○ | Δ/○ | X/X | ○/○ | X/X |
| Comparative Example 5 | Bk-18 | ○/○ | Δ/○ | ○/○ | ○/○ | Δ/○ | Δ/Δ |
| Comparative Example E | Bk-19 | — | X/X | — | — | — | — |
| Comparative Example 7 | Bk-20 | ○/○ | ○/○ | ○/○ | ○/○ | ○/○ | Δ/Δ |

In the table, "—" indicates that in the course of a number of copies, copying was discontinued due to image noise and the apparatus conditions which prevented the continuation of printing.

TABLE 10

| | After 3K endurance in NN environment | | | | | | |
|---|---|---|---|---|---|---|---|
| | Bk Toner | Fog | Lines | Image Losses | Transfer Properties | Following Properties | Toner particle size On-sleeve |
| Example 1 | Bk-12 | ○ | ○ | ○ | ○ | ○ | ○ |
| Example 2 | Bk-14 | ○ | ○ | ○ | ○ | ○ | ○ |
| Example 3 | Bk-15 | ○ | ○ | ○ | ○ | ○ | ○ |
| Comparative Example 1 | Bk-11 | Δ | x | Δ | Δ | x | x |
| Comparative Example 2 | Bk-13 | Δ | x | Δ | Δ | x | x |
| Comparative Example 3 | Bk-16 | Δ | x | Δ | Δ | x | x |
| Comparative Example 4 | Bk-17 | — | x | — | — | x | — |
| Comparative Example 5 | Bk-18 | — | x | — | — | x | x |
| Comparative Example 6 | Bk-19 | — | — | — | — | — | — |
| Comparative Example 7 | Bk-20 | Δ | x | — | — | x | x |

In the table, "—" indicates that in the course of a number of copies, copying was discontinued due to image noise and the apparatus conditions which prevented the continuation of printing.

(Evaluation as two-component developer)

Figure 4:
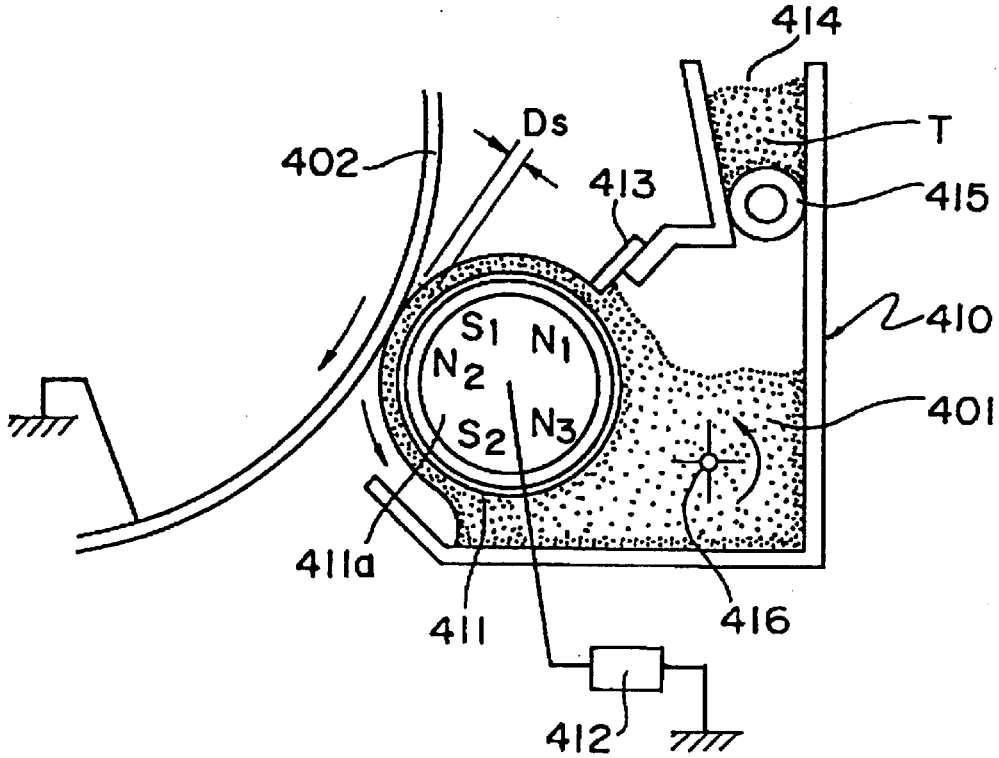
FIG. 4 is a schematic constitutional view of a developing device for performing a two-component developing method.

Referring to FIG. 4, an explanation will be given of a two-component developing method.

As illustrated in FIG. 4, in this developing device 410, developer 401 containing toner T and carrier is housed inside thereof. A cylindrical developing sleeve 411 is used in which a magnet roller 411*a* having a plurality of magnetic poles $N_1$, $S_1$, $N_2$, $S_2$ and $N_3$ are installed along the inner circumference thereof as developer transferring member 411 for transferring the developer 401. The developing sleeve 411 is rotatably placed in a manner so as to face a photosensitive member 402 with a predetermined distance Ds in a developing area.

This developing sleeve 411 is rotated in a direction reversed to that of the photosensitive member 402 so that the developing sleeve 411 and the photosensitive member 402 are moved in the same direction at the developing area at which the developing sleeve 411 and the photosensitive member 402 face each other. Thus, the developer 401 housed inside the developing device 410 is transported following the rotation of the developing sleeve 411 toward the photosensitive member 402 in the form of magnetic brush formed due to a magnetic function exerted by the magnet roller 411*a*.

A developing bias power source 412 is connected to the developing sleeve 411, and a developing bias voltage, which is an ac voltage or a voltage formed by multiplexing a dc voltage on an ac voltage, is applied from the developing bias power source 412 so that a vibrating electric field is exerted in the developing area.

On the upstream side in the transporting direction of the developer 401 from the developing area at which the developing sleeve 411 faces the photosensitive member 402, at a position facing the magnetic pole $N_1$ of the magnetic roller 411*a*, a magnetic blade 413 is placed with a predetermined gap to the developing sleeve 411 so that the amount of the developer 401 on the developing sleeve 411 is regulated by this magnetic blade 413.

In the developing device 410, a toner-storing section 414 storing toner T is attached to the upper portion thereof. Toner T in the developer 401 is supplied onto the photosensitive member 402 from the developing sleeve 411 and a developing process is carried out. When the toner density of the developer 401 inside the developing device 410 is lowered, a toner-supplying roller 415, placed below the toner storing section 414, is rotated so that toner T stored in the toner-storing section 414 is supplied to the developer 401 inside the developing device 410. Thus, toner T supplied in this manner is mixed and stirred with the developer 401 by a mixing and stirring member 416 placed inside the developing device 410, and supplied to the developing sleeve 411.

In the developer containing a mixture of carrier and toner, when the weight ratio of the toner in the developer becomes small, it is not possible to obtain a sufficient image density, and the toner is excessively charged with the result that a sufficient developing process is not available. In contrast, when the weight ratio of the toner is too high, the toner fails to be sufficiently charged by the carrier, causing fogs in copied image. For this reason, a developer having a toner weight ratio of 6 to 20% by weight, preferably 6 to 15% by weight, more preferably 6 to 11% by weight, are used.

In this developing device 410, the amount of the developer 401 on the developing sleeve 411 is regulated by the magnetic blade 413 installed on the upstream side in the transporting direction of the developer 401 from the developing area at which the developing sleeve 411 and the photosensitive member 402 faces each other. The developer 401, formed as a thin layer on the developing sleeve 411, is transported to the developing area facing the photosensitive member 402. A developing bias voltage is applied from the developing bias power source 412 so as to exert a vibrating electric field on the developing area. Toner T in the developer 401 transported by the developing sleeve 411 is supplied to a latent image portion on the photosensitive member 402 from the developing sleeve 411. Thus, a developing process is carried out.

With respect to the developer transported to the developing area by the developer transporting member, if the amount thereof is too small, toner to be supplied to the image-supporting member becomes insufficient, failing to provide copied-images having sufficient image density. For this reason, an amount of the developer to be transported to the developing area by the developer transporting member is set in the range of 0.5 to 30 mg/cm$^2$, preferably 0.7 to 10 mg/cm$^2$, more preferably 1 to 7.5 mg/cm$^2$.

In the case where the vibrating electric field is exerted between the developer transporting member and the image-supporting member in the developing area as described above in the developing process, if the vibrating electric field is too weak, the charge moving in the carrier becomes poor after the toner is discharged, causing a counter charge to remain in the carrier, with the result that the carrier tends to adhere to the image-supporting member. If the vibrating electric field is too strong, leakage tends to occur between the developer transporting member and the image-supporting member. For this reason, the vibrating voltage (Vp-p/Ds) (in which Ds is the distance between the developer transporting member and the image-supporting member at the developing area and Vp-p is the peak-to-peak value of the ac voltage to be applied) is preferably set in the range of 3.5 kV/mm$\leqq$Vp-p/Ds$\leqq$5.5 kV/mm.

Toners and carriers shown in Table 11 were mixed at toner-mixing ratios (% by weight) shown in Table 11 so that developers were prepared. Each of the developers was loaded to a developing device in Di30 (made by Minolta K.K.) having a structure as shown in FIG. 4. The distance between the developing sleeve 411 and the magnetic blade 413 was adjusted so that the amount of carriage of the developer 401 transported to the developing area by the developing sleeve 411 was adjusted to 4.5 mg/cm$^2$. The shortest distance at the facing section between the photosensitive member 402 and the developing sleeve was set to 0.35 mm. The peripheral speed of the photosensitive member 402 was set to 165 mm/s with the peripheral speed of the developing sleeve 411 being set to 300 mm/s. On the above-mentioned photosensitive member 402, the surface potential of a portion to which no toner T is supplied was set to −450 V while the surface potential of a portion to which toner T is supplied was set to −100 V.

Then, at the developing area at which the developing sleeve 411 and the photosensitive member 402 face each other, a developing bias voltage, formed by multiplexing a dc voltage of −350 V on an ac voltage having a peak-to-peak voltage value Vp-p of 1.4 kV and a frequency of 3 kHz with a rectangular waveform having a duty ratio (developing:recovering) of 1:1, was applied from the developing bias voltage source 412 so as to carry out a reverse development. Images thus formed were evaluated.

The evaluation was made on fogs, density irregularity and carrier adhesion while taking environment resistant properties into consideration.

With respect to fogs or density irregularity, copies of an image of a B/W ratio of 50% were made under HH environments (30° C., 85% RH) and LL environments (10° C., 15% RH). The copied images were ranked as follows:

○: Neither fog nor density irregularity was observed visually under the two environments.

Δ: Fog/density irregularity was slightly observed; however, no problem arose in practical use under the two environments.

X: Much fogs or density irregularity occurred at least under either of the environments; problems arose in practical use.

With respect to carrier adhesion, copies of an image of a B/W ratio of 50% were carried out under HH environments and LL environments. The copied images were ranked as follows:

○: No carrier adhesion was observed under the both environments.

Δ: Carrier adhesion was slightly observed; however, no problem arose in practical use under the both environments.

X: Much carrier adhesion occurred at least under either of the environments; problems arose in practical use.

Table 11 shows the results of the evaluation.

TABLE 11

| Two-Component Developer Agent | | | | Evaluation (initial HH/LL) | | |
|---|---|---|---|---|---|---|
| | Developer Toner | | Toner mixing | | Carrier adhe- | Density irreg- |
| | Toner | Carrier | ratio | Fog | sion | ularity |
| Example 1 | Bk-12 | Carrier-4 | 10 | ○ | ○ | ○ |
| Example 2 | Bk-12 | Carrier-5 | 10 | ○ | ○ | ○ |
| Example 3 | Bk-12 | Carrier-6 | 10 | ○ | ○ | ○ |
| Example 4 | Bk-12 | Carrier-8 | 10 | ○ | ○ | ○ |
| Example 5 | Bk-12 | Carrier-9 | 10 | ○ | ○ | ○ |
| Comparative Example 1 | Bk-11 | Carrier-1 | 10 | x | Δ | Δ |
| Comparative Example 2 | Bk-11 | Carrier-2 | 10 | x | x | Δ |
| Comparative Example 3 | Bk-11 | Carrier-3 | 10 | Δ | x | ○ |
| Comparative Example 4 | Bk-11 | Carrier-7 | 10 | Δ | x | ○ |
| Comparative Example 6 | Bk-11 | Carrier-10 | 10 | Δ | x | Δ |
| Comparative Example 7 | Bk-11 | Carrier-11 | 10 | Δ | x | ○ |
| Comparative Example 8 | Bk-11 | Carrier-12 | 10 | x | Δ | x |
| Comparative Example 9 | Bk-11 | Carrier-13 | 10 | x | ○ | x |
| Example 6 | Bk-12 | Carrier-2 | 10 | ○ | Δ | ○ |
| Example 7 | Bk-11 | Carrier-5 | 10 | ○ | ○ | Δ |

Moreover, the developer in example 1 shown in Table 11 was subjected to durability test in which an image having a B/W ratio of 5% was duplicated on 10,000 sheets of paper by means of Di-30 (made by Minolta K.K.) with a developing device converted as shown in FIG. 4. As a result, no problem arose with density irregularity, fog, etc. in copied images.

(Evaluation as magnetic toner)

Figure 5:
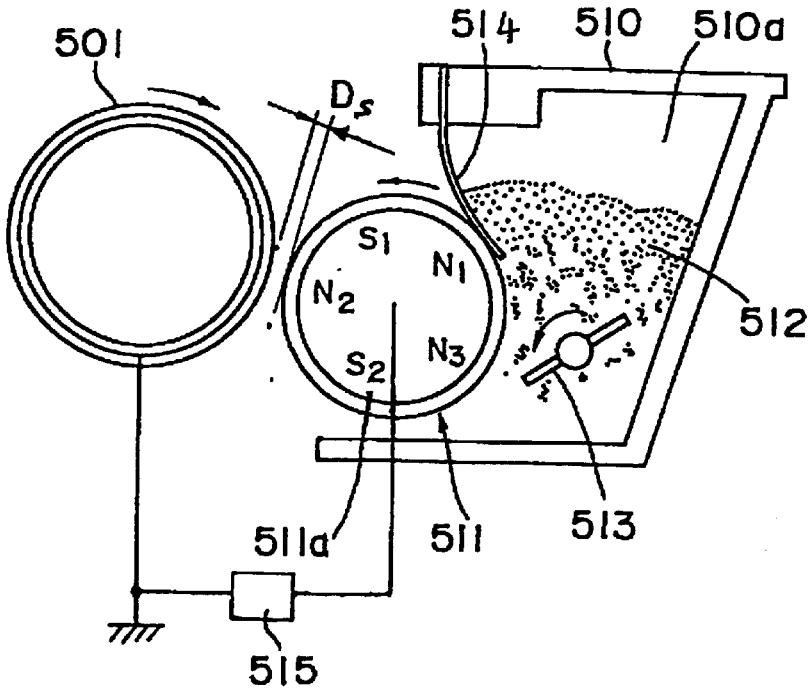
FIG. 5 is a schematic constitutional view of a developing device for performing a developing method of a magnetic toner.

Referring to FIG. 5, an explanation will be given of one example of a developing device used for evaluating the developing conditions.

As illustrated in FIG. 5, a developing sleeve (511) made of cylindrical aluminum (with an urethane layer of a thickness of 30 $\mu$m on its surface) is used as a developer transferring member (511) for transferring a developer. A magnet roller (511*a*) having a plurality of $N_1$, $S_1$, $N_2$ and $S_2$ is arranged fixedly in the inner circumference of the sleeve. This developing sleeve (511) is supported so as to be freely rotated in such a manner as to face the photosensitive member (501) serving as the image-supporting member at the developing area with an appropriate distance (Ds).

A developer 512 is stored and an agitator 513 is installed on the side opposite to the developing area at which the developer-supporting member 511 and the image-supporting member 501 face each other inside the device main body 510. The developer 512 stored inside the device main body 510 is supplied onto the surface of the developer-supporting member 511 by rotating the agitator 513.

Then, the developer-supporting member 511 is rotated. On the way of transporting the developer 512 held on the surface of the developer-supporting member 511 to the developing area facing the image-supporting member 501, a regulating member 514 installed inside the device main body 510 is pressed onto the surface of the developer-supporting member 511 so that an amount of the developer 512 transported by the developer-supporting member 511 to the developing area is regulated and the developer 512 on the surface of the developer-supporting member 511 is frictionally charged.

The developer 512 whose amount of carriage is regulated by the regulating member 514 and which is frictionally charged by the regulating member 514 is transported by the developer-supporting member 511 to the developing area facing the image-supporting member 501 at which the developing bias voltage is applied to the developer-supporting member 511 from the power source 515 so that the developer 512 held on the surface of the developer-supporting member 511 is supplied to an electrostatic latent image formed on the image-supporting member 501.

In the developing device in which the developer 512 is held on the surface of the developer-supporting member 511 facing the image-supporting member 501 with a predetermined distance, and directed to the developing area facing the image-supporting member, the peak-to-peak value Vpp of the alternating voltage applied to the developer-supporting member and the distance Ds with which the conductive base in the developer-supporting member and the image-supporting member face each other are set to satisfy the relationship: Vpp/Ds=7 kV/mm.

Evaluation was made on transferring properties, fog, sleeve filming and particle size of toner on the sleeve. The results are ranked as follows:

(1) Transferring properties:

After 10 copies of an image having a B/W of 30% were made, a copy of an image having a B/W of 100% was made. Evaluation was made on its density irregularity.

○: No density irregularity.

Δ: Density irregularity slightly occurred; however, no problem arose in practical use.

X: Density irregularity occurred, and problems arose in practical use.

(2) Fog:

Ten (10) copies of an image (white) having a B/W of 0% were continuously printed out. The copied images were evaluated on fog.

○: No fog.

Δ: Fog slightly occurred; however, no problem arose in practical use.

X: Fog occurred, causing problems in practical use.

(3) Sleeve filming:

After 100 copies were printed out under each of the initial, HH environments and LL environments, filming on the sleeve was evaluated. After 3,000 copies were made under NN environments, filming on the sleeve was also evaluated.

○: No filming occurred.

Δ: Filming slightly occurred; however, no problem arose in practical use.

X: Filming caused image noise, raising problems in practical use.

(4) Particle size of toner on the sleeve:

Evaluation was made on the difference in particle size of toner in hopper (average particle size & number % of fine particle components)

○: The difference was less than 10%.

Δ: The difference ranged from 10 to 20%.

X: Particle size selection of not less than 20% arose.

The results of evaluation are listed in Tables 12 and 13. Table 12 shows the results of evaluation obtained from copies printed out under HH environments (30° C., 85% RH) and LL environments (10° C., 15% RH).

Table 13 shows the results of evaluation obtained after 3,000 copies were made under NN environments (25° C., 55% RH).

TABLE 12

| | Magnetic Toner | | | | |
|---|---|---|---|---|---|
| | | Evaluation (initial HH/LL) | | | |
| | Toner | Transportability | Fog | Sleeve filming | Particle size of toner on sleeve |
| Example 1 | Bk-22 | ○ | ○ | ○ | ○ |
| Example 2 | Bk-24 | ○ | ○ | ○ | ○ |
| Example 3 | Bk-25 | ○ | ○ | ○ | ○ |
| Comparative Example 1 | Bk-21 | ○ | ○ | ○ | ○ |
| Comparative Example 2 | Bk-23 | Δ | ○ | ○ | ○ |
| Comparative Example 3 | Bk-26 | ○ | x | ○ | x |
| Comparative Example 4 | Bk-27 | Δ | ○ | ○ | x |
| Comparative Example 5 | Bk-28 | Δ | Δ | Δ | x |
| Comparative Example 6 | Bk-29 | x | Δ | x | x |
| Comparative Example 7 | Bk-30 | ○ | ○ | ○ | Δ |

TABLE 13

| | Magnetic Toner | | | | |
|---|---|---|---|---|---|
| | | After 3K copies in NN environment | | | |
| | Toner | Transportability | Fog | Sleeve filming | Particle size of toner on sleeve |
| Example 1 | Bk-22 | ○ | ○ | ○ | ○ |
| Example 2 | Bk-24 | ○ | ○ | ○ | ○ |
| Example 3 | Bk-25 | ○ | ○ | ○ | ○ |
| Comparative Example 1 | Bk-21 | — | — | x | — |
| Comparative Example 2 | Bk-23 | — | — | x | — |
| Comparative Example 3 | Bk-26 | x | x | Δ | x |
| Comparative Example 4 | Bk-27 | — | — | x | — |
| Comparative Example 5 | Bk-28 | x | x | x | x |
| Comparative Example 6 | Bk-29 | x | x | x | x |
| Comparative Example 7 | Bk-30 | Δ | x | x | x |

In the table, "—" indicates that in the course of a number of copies, copying was discontinued due to image noise and the apparatus conditions which prevented the continuation of printing.

The present invention provides a developer (toner and/or carrier) which is obtained by a kneading-pulverizing method in which particle shape is controlled so that the particles are spherical and uniform, and the developer of the present invention has less number of pores located on the surface thereof and has a superior smoothness. The present invention makes it possible to achieve a superior image-forming properties as well as uniform charging properties, and also to ensure a stable image-forming performance for a long time.

What is claimed is:

1. A non-magnetic toner, comprising:

toner particles comprising colored resin-particles containing at least a binder resin and a colorant, and inorganic fine particles fixed on the surface of the colored resin-particles, the toner particles having an average degree of roundness of not less than 0.960 and a standard deviation of degree of roundness of not more than 0.040.

2. The non-magnetic toner of claim 1, in which the inorganic fine particles have a BET specific surface area of 10 to 350 $m^2/g$ and a quantity of addition of the inorganic fine particles is 0.05 to 6 parts by weight relative to 100 parts by weight of the toner particles.

3. The non-magnetic toner of claim 1, in which the inorganic fine particles have a BET specific surface area of 100 to 350 $m^2/g$.

4. The non-magnetic toner of claim 1, in which the inorganic fine particles have a BET specific surface area of 10 to 100 $m^2/g$.

5. The non-magnetic toner of claim 1, in which the inorganic fine particles comprise first inorganic fine particles having a BET specific surface area of 100 to 350 $m^2/g$ and second inorganic fine particles having a BET specific surface area of 10 to 100 $m^2/g$, the BET specific surface area of the first inorganic fine particles is at least 30 $m^2/g$ larger than that of the second inorganic fine particles.

6. The non-magnetic toner of claim 1, in which the toner particles are prepared by mixing the inorganic fine particles with the colored resin-particles which are prepared by a pulverizing method, and the mixture is subjected to a instantaneous heat treatment.

7. The non-magnetic toner of claim 1, further containing a post-treating agent having a BET specific surface area of 1 to 350 $m^2/g$, the post-treating agent being admixed externally to the toner particles.

8. The non-magnetic toner of claim 7, in which the post-treating agent has a BET specific surface area of 100 to 350 $m^2/g$.

9. The non-magnetic toner of claim 7, in which the post-treating agent has a BET specific surface area of 1 to 100 $m^2/g$.

10. The non-magnetic toner of claim 7, in which the post-treating agent comprises a first post-treating agent having a BET specific surface area of 100 to 350 $m^2/g$ and a second post-treating agent having a BET specific surface area of 1 to 100 $m^2/g$, the BET specific surface area of the first post-treating agent is at least 30 $m^2/g$ larger than that of the second post-treating agent.

11. The non-magnetic toner of claim 1, in which the binder resin has a glass transition point of 50 to 75° C., a softening point of 80 to 120° C., a number-average molecular weight of 2,000 to 30,000 and a ratio of weight-average molecular weight/number-average molecular weight of 2 to 20.

12. The non-magnetic toner of claim 1, in which the toner particles have an average degree of roundness of not less than 0.960 and a standard deviation of degree of roundness of not more than 0.035.

13. The non-magnetic toner of claim 1, in which the toner particles have an average degree of roundness of not less than 0.965 and a standard deviation of degree of roundness of not more than 0.035.

14. The non-magnetic toner of claim 1, having $D/d_{50} \geqq 0.40$ (in which $d_{50}$ is a weight-average particle size of toner; $D=6/(\rho \cdot s)$ ($\rho$ is a true density of toner ($g/cm^3$); and S is a BET specific surface area ($m^2/g$) of toner)).

15. The non-magnetic toner of claim 14, in which $D/d_{50}$ is in the range of 0.40 to 0.80.

16. The non-magnetic toner of claim 14, in which the binder resin comprises a first resin having a glass transition point of 50 to 75° C. and a softening point of 80 to 125° C. and a second resin having a glass transition point of 50 to 75° C. and a softening point of 125 to 160° C., the softening point of the second resin being higher than that of the first resin by not less than 10° C.

17. A magnetic toner, comprising:

toner particles comprising colored resin-particles containing at least a binder resin, a colorant and magnetic particles, and inorganic fine particles fixed on the surface of the colored resin-particles, the toner particles having an average degree of roundness of not less than 0.950 and a standard deviation of degree of roundness of not more than 0.040.

18. The magnetic toner of claim 17, in which the inorganic fine particles have a BET specific surface area of 10 to 350 $m^2/g$ and a quantity of addition of the inorganic fine particles is 0.05 to 6 parts by weight relative to 100 parts by weight of the toner particles.

19. The magnetic toner of claim 17, in which the inorganic fine particles have a BET specific surface area of 100 to 350 $m^2/g$.

20. The magnetic toner of claim 17, in which the inorganic fine particles have a BET specific surface area of 10 to 100 $m^2/g$.

21. The magnetic toner of claim 17, in which the inorganic fine particles comprise first inorganic fine particles having a BET specific surface area of 100 to 350 $m^2/g$ and second inorganic fine particles having a BET specific surface area of 10 to 100 $m^2/g$, the BET specific surface area of the first inorganic fine particles is at least 30 $m^2/g$ larger than that of the second inorganic fine particles.

22. The magnetic toner of claim 17, in which the toner particles are prepared by mixing the inorganic fine particles with the colored resin-particles which are prepared by a pulverizing method, and the mixture is subjected to a instantaneous heat treatment.

23. The magnetic toner of claim 17, further containing a post-treating agent having a BET specific surface area of 1 to 350 $m^2/g$, the post-treating agent being admixed externally to the toner particles.

24. The magnetic toner of claim 23, in which the post-treating agent has a BET specific surface area of 100 to 350 $m^2/g$.

25. The magnetic toner of claim 23, in which the post-treating agent has a BET specific surface area of 1 to 100 $m^2/g$.

26. The magnetic toner of claim 23, in which the post-treating agent comprises a first post-treating agent having a BET specific surface area of 100 to 350 $m^2/g$ and a second post-treating agent having a BET specific surface area of 1 to 100 $m^2/g$, the BET specific surface area of the first post-treating agent is at least 30 $m^2/g$ larger than that of the second post-treating agent.

27. The magnetic toner of claim 17, in which the binder resin comprises a first resin having a glass transition point of 50 to 75° C. and a softening point of 80 to 125° C. and a second resin having a glass transition point of 50 to 75° C. and a softening point of 125 to 160° C., the softening point of the second resin being higher than that of the first resin by not less than 10° C.

28. The magnetic toner of claim 17, in which the toner particles have an average degree of roundness of not less than 0.955 and a standard deviation of degree of roundness of not more than 0.036.

29. The magnetic toner of claim 17, having $D/d_{50} \geqq 0.20$ (in which $d_{50}$ is a weight-average particle size of toner; $D=6/(\rho \cdot s)$ ($\rho$ is a true density of toner ($g/cm^3$); and S is a BET specific surface area ($m^2/g$) of toner)).

30. The magnetic toner of claim 29, in which $D/d_{50}$ is in the range of 0.20 to 0.55.

31. A developing method, comprising the steps of;

feeding a developer to a developer-supporting member arranged to face a image-supporting member with a specified distance, the developer comprising a toner and a carrier, the toner comprising toner particles, the toner particles comprising colored resin-particles containing at least a binder resin and a colorant and inorganic fine particles fixed on the surface of the colored resin-particles, and the toner particles having an average degree of roundness of not less than 0.960 and a standard deviation of degree of roundness of not more than 0.040;

regulating an amount of the developer on the developer-supporting member so that an amount of 0.5 to 30 $mg/cm^2$ is transported to a developing area; and developing an electrostatic latent image formed on the image-supporting member with a toner on the developer-supporting member under a vibrating electric field.

32. The developing method of claim 31, in which the carrier comprises a binder resin and a magnetic particles.

33. The developing method of claim 31, in which the toner particles have the average degree of roundness of not less than 0.965 and the standard deviation of degree of roundness of not more than 0.035.

34. The developing method of claim 31, in which the toner has $D/d_{50} \geqq 0.4$ (in which $d_{50}$ is a weight-average particle size of toner; $D=6/(\rho \cdot s)$ ($\rho$ is a true density of toner ($g/cm^3$); and S is a BET specific surface area ($m^2/g$) of toner)).

35. A magnetic carrier, comprising:

carrier particles comprising magnetic particles containing a binder resin and magnetic particles, and inorganic fine particles fixed on the surface of the magnetic particles, the carrier particles having an average degree of roundness of not less than 0.940 and a standard deviation of degree of roundness of not more than 0.055.

36. The magnetic carrier of claim 35, in which the inorganic fine particles have a BET specific surface area of 100 to 350 $m^2/g$.

37. The magnetic carrier of claim 35, in which the inorganic fine particles have a BET specific surface area of 10 to 100 $m^2/g$.

38. The magnetic carrier of claim 35, having $D/d_{50} \geqq 0.04$ (in which $d_{50}$ is a weight-average particle size of carrier; $D=6/(\rho \cdot s)$ ($\rho$ is a true density of carrier ($g/cm^3$); and s is a BET specific surface area ($m^2/g$) of carrier)).

* * * * *